US010918928B2

(12) United States Patent
Almeras

(10) Patent No.: US 10,918,928 B2
(45) Date of Patent: Feb. 16, 2021

(54) REACTIVE-MOBILITY TRAINING APPLIANCE COMPRISING A PUNCHING BAG

(71) Applicant: Antoine Bellando De Castro, Monaco (MC)

(72) Inventor: Lilian Almeras, Soorts-Hossegor (FR)

(73) Assignee: Antoine Bellando De Castro, Monaco (MC)

( * ) Notice: Subject to any disclaimer, the term of this patent is extended or adjusted under 35 U.S.C. 154(b) by 74 days.

(21) Appl. No.: 16/114,846

(22) Filed: Aug. 28, 2018

(65) Prior Publication Data

US 2018/0361222 A1 Dec. 20, 2018

Related U.S. Application Data

(62) Division of application No. 14/762,480, filed as application No. PCT/FR2014/050172 on Jan. 31, 2014, now Pat. No. 10,065,098.

(51) Int. Cl.
*A63B 69/20* (2006.01)

(52) U.S. Cl.
CPC ..... *A63B 69/20* (2013.01); *A63B 69/201* (2013.01); *A63B 69/206* (2013.01); *A63B 69/208* (2013.01)

(58) Field of Classification Search
CPC ..... A63B 69/20; A63B 69/201; A63B 69/208; A63B 69/206; A63B 21/0602; A63B 21/0603; A63B 21/0604; A63B 69/24; A63B 69/34; A63B 69/345
See application file for complete search history.

(56) References Cited

U.S. PATENT DOCUMENTS

| | | | | |
|---|---|---|---|---|
| 1,287,176 A | | 12/1918 | Armstrong | |
| 1,703,012 A | | 2/1929 | McNamara | |
| 2,197,545 A | | 4/1940 | Bachman | |
| 3,680,861 A | | 8/1972 | Schmidt | |
| 5,437,590 A | * | 8/1995 | D'Alto | A63B 69/208 473/441 |
| 5,702,327 A | | 12/1997 | Fullbright | |
| 5,788,612 A | | 8/1998 | Rennick | |
| 5,921,896 A | | 7/1999 | Boland | |
| 6,027,435 A | | 2/2000 | Nadorf | |

(Continued)

FOREIGN PATENT DOCUMENTS

FR 2 841 792 A1 1/2004

OTHER PUBLICATIONS

International Search Report, dated Apr. 2, 2014, from corresponding PCT Application.

*Primary Examiner* — Sundhara M Ganesan
(74) *Attorney, Agent, or Firm* — Im IP Law; Chai Im; C. Andrew Im

(57) ABSTRACT

A training appliance to practice combat sports, contact sports or grappling sports, includes a punching bag having an envelope including a closing wall forming a bottom wall at the lower end thereof, and a second closing wall at the top end. The appliance includes a horizontal base for supporting the bag on the ground, that can be immobilized on the ground and on which the punching bag rests, by the wall thereof. A mechanical connection is established between the base and the wall, authorizing the pivoting movement of the bag around the point of contact between the wall and the sole. The bag also includes at least one unit for returning same to the vertical position.

16 Claims, 14 Drawing Sheets

(56) References Cited

U.S. PATENT DOCUMENTS

Figure 2:
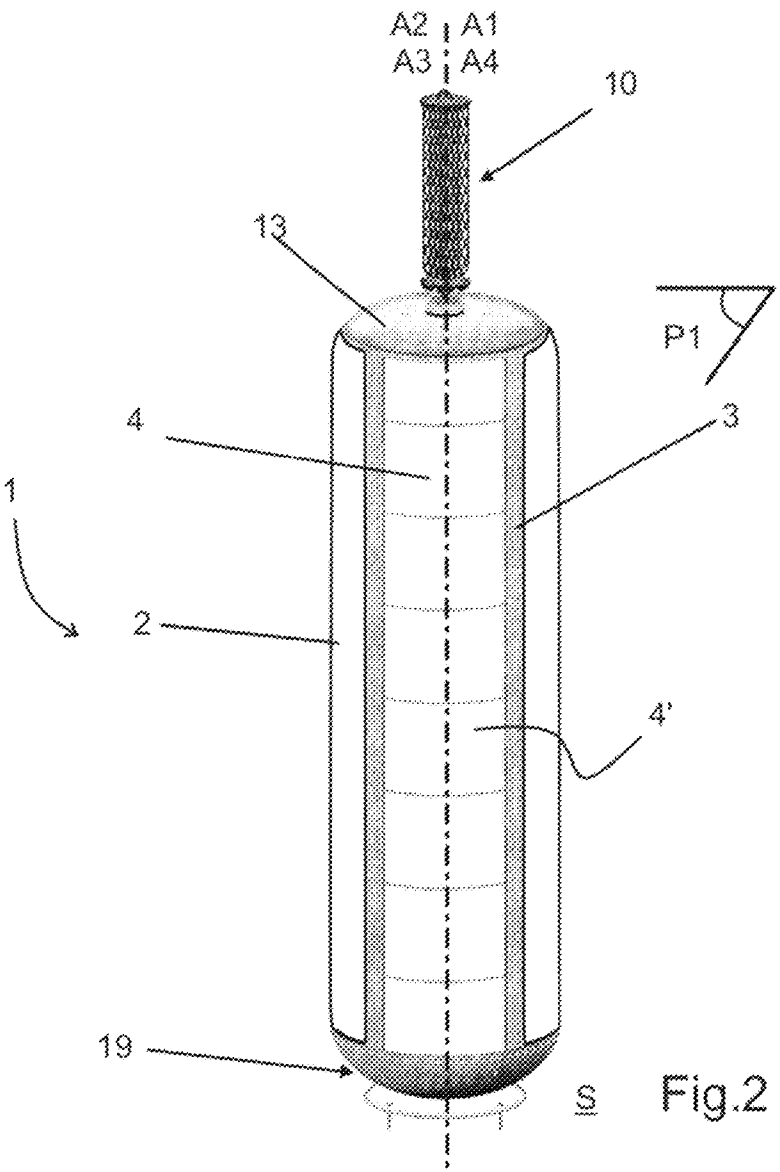

| | | | | |
|---|---|---|---|---|
| 6,080,089 | A | 6/2000 | Nicholson | |
| 6,390,958 | B1 | 5/2002 | Chu | |
| 6,464,621 | B1 | 10/2002 | Chen | |
| 6,790,167 | B1 | 9/2004 | Carlin | |
| 7,063,648 | B1 | 6/2006 | Brigham | |
| 7,357,760 | B1 | 4/2008 | Rios | |
| 7,704,194 | B1 * | 4/2010 | Chen | A63B 69/208 482/83 |
| 2008/0188360 | A1 | 8/2008 | Chu | |
| 2009/0264263 | A1 * | 10/2009 | Yang | A63B 69/0075 482/85 |
| 2013/0137554 | A1 * | 5/2013 | Knight | A63B 69/345 482/85 |
| 2015/0352423 | A1 * | 12/2015 | Almeras | A63B 69/20 482/89 |
| 2016/0059100 | A1 * | 3/2016 | Chen | A63B 69/34 482/83 |
| 2016/0059101 | A1 | 3/2016 | Chen | |

* cited by examiner

REACTIVE-MOBILITY TRAINING APPLIANCE COMPRISING A PUNCHING BAG

RELATED APPLICATIONS

This application is a divisional of U.S. application Ser. No. 14/762,480 filed Jul. 22, 2015, which is § 371 application of PCT/FR2014/050172 filed Jan. 31, 2014, which claims priority from French Patent Application No. 13 50818 filed Jan. 31, 2013 and French Patent Application No. 13 63191 filed Dec. 20, 2013, each of which is incorporated herein by reference in its entirety.

TECHNICAL FIELD

The invention relates to a training appliance comprising a punching bag for practising combat and/or contact or grappling sports, notably for increasing the muscular strength, speed and reflexes of the person practicing. Its subject matter is such a training appliance including a punching bag.

BACKGROUND OF THE INVENTION

Known in the prior art are punching bags suspended from a supporting structure. This supporting structure may be an upper suspension ring fixed either directly to the ceiling or to a boom installed at the upper end of a column fixed to the ground.

There is known from the document FR 2 841 792 a punching bag for training in contact sports such as boxing, karate, etc. The punching bag comprises a vertical tube surrounded by an elastically deformable synthetic foam cylindrical sleeve. The punching bag is intended to receive blows struck by a user.

This bag is suspended above the ground and the upper and lower ends are respectively connected to upper and lower fixings by two connecting means at least one of which is elastically deformable.

SUMMARY OF THE INVENTION

Technical Problem

The disadvantage of these various punching bags is that their weight is totally or mostly supported by the upper suspension ring which requires to be firmly fixed either to the ceiling or to the boom. In the case of a fixing to the ceiling, the structure of the latter must be sufficiently strong to support not only the weight of the bag but also, notably, the forces resulting from the acceleration imparted to the bag by the blows struck by the person practicing.

Another disadvantage of the known bags is that they are dedicated to a single type of activity and cannot be used for training in tackling as practiced for example in rugby or American football. Moreover, where training in tackling is concerned, existing bags cannot be raised autonomously.

There is therefore a requirement for a multipurpose punching bag suitable for practicing percussion sports on the one hand and percussion and/or grappling sports on the other hand. There more particularly exists a requirement for a punching bag suitable for training in contact and/or combat sports (boxing, Thai boxing, wrestling, mixed martial arts (MMA), etc.), martial arts (karate, kung fu, sambo), self-defense (krav maga, penchak silat, etc.) and team combat games (rugby, American football, etc.).

Even more particularly, for practicing percussion sports, there exists a requirement for a punching bag with reactive mobility adjustable as a function of a percussion power. In other words, there exists a requirement for a punching bag offering mobility of the punching bag that is intrinsically controlled on the basis of characteristics inherent to the punching bag, such control being adapted as a function of the percussion power applied by the user. There exists a requirement for a punching bag designed for percussion training of all the limbs of a user (fists, arms, elbows, knees, tibias, feet, head) and all striking heights, such a punching bag offering at one and the same time the advantages of a speed punching bag (of the "speed bag" type), a heavy punching bag (of the "heavy" bag type), without the drawbacks of each of these. There also exists a requirement for such a punching bag also offering a realistic oscillatory movement, which is not the case in prior art suspended punching bags, for example, oscillation of which is inverted, the top of prior art suspended punching bags remaining fixed and the bottom of prior art suspended punching bags being mobile. Likewise, it is desirable to have a punching bag offering easy fixing of the punching bag, notably to a low ceiling and to the ground, in contrast to prior art heavy punching bags that generally require the use of a boom or anchor points that are robust and bulky. Finally, it is also desirable to have a punching bag offering a resistance and a reactive mobility of the punching bag that is induced by a thrust or an impact of adjustable power, which is lacking in prior art suspended punching bags.

Even more particularly, and for practicing percussion and/or grappling sports, there exists a requirement for a punching and tackling bag with reactive mobility and dropping resistance adjustable as a function of the power of an impact generated by the user. In other words, there exists a requirement for a punching and tackling bag that provides a response adapted to the power of the impact. To put this another way, upon tackling the punching and tackling bag, it is desirable for the latter to offer a proportionate and realistic response to the impact that the punching and tackling bag receives from the user, this response being intrinsically controlled on the basis of characteristics inherent to the punching and tackling bag. There also exists a requirement for a punching and tackling bag that is designed both for percussion training of all of the limbs of the user (fists, arms, elbows, knees, tibias, feet, head) on a vertical and horizontal plane, as well throwing the punching and tackling bag to the ground with a system for automatically returning the punching and tackling bag to the vertical position, such automatic return being nevertheless realistic and free of risk to the user. In the family of punching and tackling bags, it is desirable to have a punching and tackling bag offering at one and the same time the advantages of a speed punching bag (of the "speed bag" type), a heavy punching bag (of the "heavy" bag type), and a tackling bag without the disadvantages of each of these bags and notably allowing an oscillatory movement of an upper part of the punching and tackling bag that is realistic, which is not the case in prior art suspended punching and tackling bags the oscillation of which is inverted, the top of the prior art punching and tackling bag remaining fixed and the bottom of the prior art punching and tackling bag being mobile. It is also desirable to have a punching and tackling bag offering ease of fixing of the punching and tackling bag to a low ceiling and to the ground whereas a prior art punching and tackling bag does not offer such ease and generally makes it obligatory to use a boom or anchor points that are robust and bulky. Moreover, it is also desirable to have a punching and tackling bag offering a resistance and a reactive mobility of the punching and tackling bag that is induced by a thrust or impact of adjustable power, which is lacking in prior art suspended punching and tackling bags. Finally, it is desirable to have a punching and tackling bag offering automatic raising of the punching and tackling bag after it is thrown to the ground, whereas prior art punching and tackling bags must be raised manually.

Technical Solution

To this end, the training appliance in accordance with the present invention for practicing combat, contact or grappling sports, comprising a punching bag formed of a shock absorbing filling material disposed in the internal volume of a substantially cylindrical envelope comprising at the lower end a closing wall constituting a bottom wall and at the upper end a second closing wall, characterized in that it comprises a horizontal base for supporting the bag on the ground, adapted to be immobilized on the ground, on which the bottom wall of the envelope of the punching bag rests, a mechanical connection allowing pivoting movement of the bag in at least one vertical plane and around the point of contact between the bottom wall and the base, being established between said supporting base and the punching bag and said punching bag further including at least one means for returning it to the vertical position, said means being adapted to occupy a stable initial state in which the bag is vertical and an unstable final state in which the bag is horizontal and laid on the ground.

The present invention improves on the situation by proposing a training appliance that addresses the above requirements by being suitable for practicing percussion sports on the one hand and percussion and/or grappling sports on the other hand, such an appliance being suitable, for example, for training in contact and/or combat sports (boxing, Thai boxing, wrestling, mixed martial arts (MMA), etc.), martial arts (karate, kung fu, sambo, etc.), self-defense (krav maga, penchak silat, etc.) and team combat games (rugby, American football, etc.), the punching bag of such an appliance notably having reactive mobility and dropping resistance adjustable as a function of the power of an impact generated by the user, such an appliance offering a facility of automatic raising of the bag after it is thrown to the ground and such an appliance further offering a facility for fixing to a low ceiling or to any other suitable structure as well as to the ground.

Moreover, the weight of the punching bag is now supported entirely by the supporting base and consequently by the ground, the fixing to a ceiling or the like now having no need of a high resistance to pulling it out.

In accordance with another feature of the invention, the mechanical connection between the bag and the base is advantageously of the ball-joint type. Such an arrangement confers on the bag of the appliance a latitude for inclination in an infinite number of vertical planes and also a latitude for movement in rotation about its longitudinal axis.

In accordance with another feature of the invention, the or a means for reverting to the vertical position includes a member for fixing to a ceiling.

In accordance with another feature of the invention, the bottom wall is convex and forms a spherical dome. Such an arrangement facilitates the pivoting movement of the bag and its return to the vertical by enabling rolling movement of the bottom wall on the base.

In accordance with another feature of the invention, the appliance comprises, housed in the filling material of the bag, a rigid central tube extending from the top wall to the bottom wall of the envelope, the upper and lower openings of said tube respectively communicating with a hole through the top wall and a hole through the bottom wall, the or a return means being at least partly housed in the central tube.

By constituting a framework, the central tube confers on the punching bag a rigidity in the direction of its height. This notably prevents the bag from collapsing on itself by virtue of its weight and the blows that it absorbs.

Moreover, such an arrangement has the effect of enveloping and protecting, at least in part, the or at least one of the return means.

Finally, another benefit of such an arrangement is to reduce the degree of shock absorbing of the bag by stiffening it. The shock absorbing function is in the case of the present invention notably provided by the or one of the means for returning the bag to the vertical position.

In accordance with another feature of the invention, the or the first return means is constituted by an elastic member mounted in tension between an attachment point in the tube, in the lower area of the latter, and an attachment point in the supporting base.

Such an arrangement, in addition to the return to the vertical position, prevents any scraping of the bag on the supporting base.

Alternatively, in accordance with another embodiment of the appliance according to the invention, the first return means is formed of a ballast weight installed in the lower part of the bag around the central tube and in conjunction with this feature the bottom wall defines a hemispherical volume, the center of mass of the ballast weight being below the center of the horizontal equatorial section of the hemispherical volume in order to form a punching bag.

Such an arrangement avoids the use of any element liable to wear for the implementation of the first return means.

In accordance with another feature of the invention, the or the second return means is formed of a flexible elongate element in the form of a cable and fixed by one of its ends to an attachment point fastened to the central tube of the punching bag, its other end, external to the bag, being mechanically connected to the a member adapted to be fixed to a ceiling or like structure, said cable being subjected to forces tending to shorten the distance between the attachment member and said bag and to urge it toward its initial state.

Such an arrangement is of a kind to exert at the upper end of the bag a radial force able to generate a pivoting moment tending to return said bag to the vertical position.

In accordance with another feature of the invention, the attachment point of the cable in the tube is the drum of a winder with a return spring mounted in said tube, either in the lower part or in the upper part of the latter.

With such an arrangement, the cable may be made of a non-extensible material.

Alternatively, in accordance with another feature of the invention, the cable is at least in part elastically deformable, is fixed by one of its ends in the upper part of the tube and is wound onto the sheave of a lower pulley the yoke of which is fixedly mounted in the lower part of the tube.

Such an arrangement enables the use of a cable having a relatively long elastically deformable part so that the bag can be laid on the ground. Such a bag can then be used for training in tackling.

In accordance with another feature of the invention, the cable is wound onto the sheave of at least one upper pulley the yoke of which is fixedly mounted in the upper part of the tube and onto the sheaves of at least one lower pulley the yoke of which is fixedly mounted in the lower part of the tube. Such an arrangement enables use of a longer cable.

In accordance with another feature of the invention, the yoke of the lower pulley of the second elastic return means is fixed to the central tube, but alternatively, in accordance with another feature of the invention, the first return means, in the form of an elastic member, is fixed to the lower pulley of the second elastic return means, this second pulley being mounted in the central tube without being fixed to it.

By virtue of this arrangement, the two elastic return means are directly connected to each other and combine their effects. Moreover, the second means is now arranged as a block and tackle.

In accordance with another feature of the invention, there is provided an upper retaining system elastically deformable in the lengthwise direction, mechanically disposed between the ceiling attachment member and the corresponding end of the cable.

This upper retaining system also contributes to returning the bag to the vertical position and additionally has the effect of introducing supplementary reactivity of the bag to the blows received. The function of absorbing the shock of the impacts is also provided by this system.

In accordance with another feature of the invention, the upper retaining system comprises a central elastic element and a plurality of peripheral elastic elements, said elements being parallel to one another and arranged in bundles and being fixed by their ends to an upper plate and a lower plate spaced from each other, said peripheral elastic elements being individually and detachably fixed to at least one of said two plates.

Such an arrangement enables adjustment of the stiffness of the retaining system.

In accordance with another feature of the invention, there is disposed between the upper retaining system and the second return means a means able to set a mechanical triggering threshold value below which only the upper retaining system is loaded in extension and above which the second return means is also loaded in extension when the bag is loaded in pivoting.

Accordingly, from a certain degree of pivoting of the bag, the return action exerted by the upper retaining system is inhibited, the return action then being exerted by the second return means. By virtue of these arrangements it now becomes possible to reproduce the reactions of the body of an adversary.

In accordance with another feature of the invention, the means adapted to fix a mechanical triggering threshold is formed on the one hand of a magnetizable metal wall fixed to the top wall of the bag or forming part of the latter and a magnet in magnetic contact with the magnetizable wall, said magnet being fixed by a coupling to the upper retaining system, the cable of the second elastic return means having its corresponding end fixed to said magnet. The triggering threshold is determined by the force of magnetic attraction between the magnet and the associated metal wall. To adjust this triggering threshold there is provided, in accordance with another feature of the invention, between the magnet and the associated wall, a nonmagnetic material shim of appropriate thickness.

In accordance with another feature of the invention, the magnet includes a projecting rod to the free end of which is fixed the upper retaining system, the projection that said rod forms on the magnet being adjustable in height in order to form a lever arm, thereby also adjusting the value of the mechanical triggering threshold.

The projecting part of the rod forms a lever arm the length of which determines the value of the pivoting moment imparted to the magnet when the bag occupies a position inclined relative to the vertical, the value of this moment being also determined by the value of the intensity of the radial component of the force applied to the rod by the upper retaining system.

BRIEF DESCRIPTION OF THE FIGURES AND THE DRAWINGS

Figure 1:
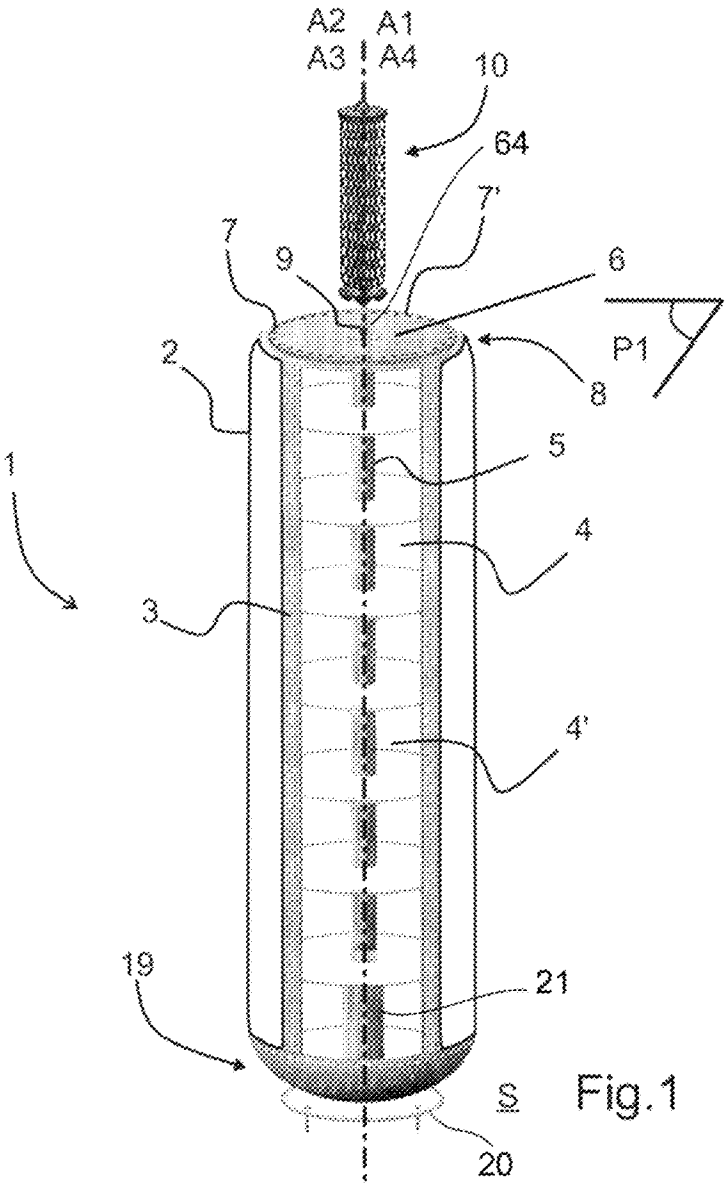
Figure 4:
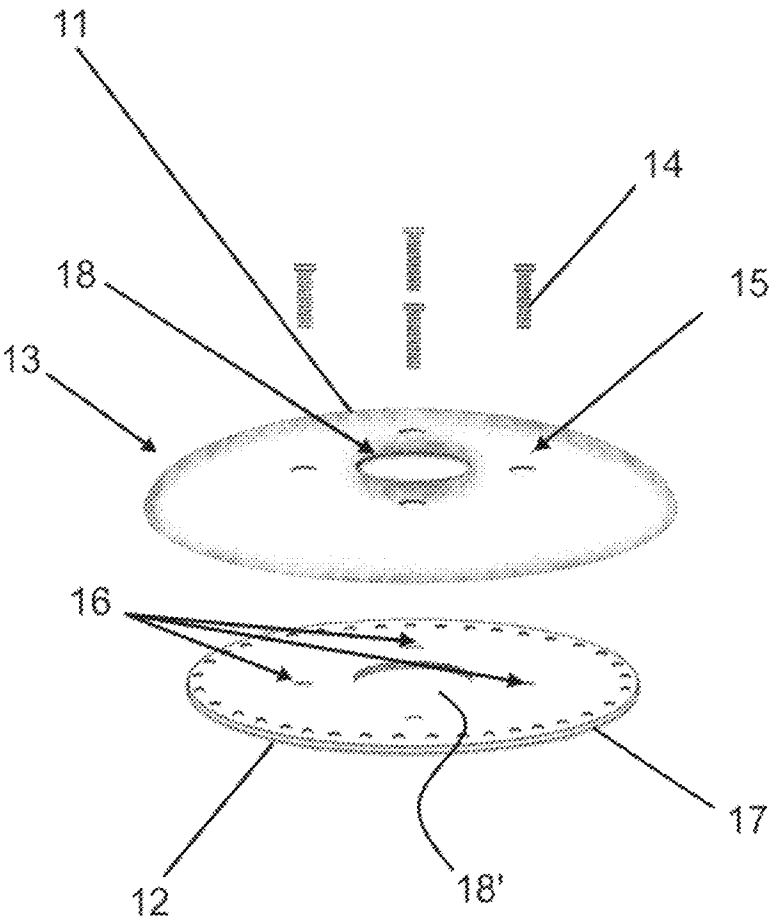
Figure 3:
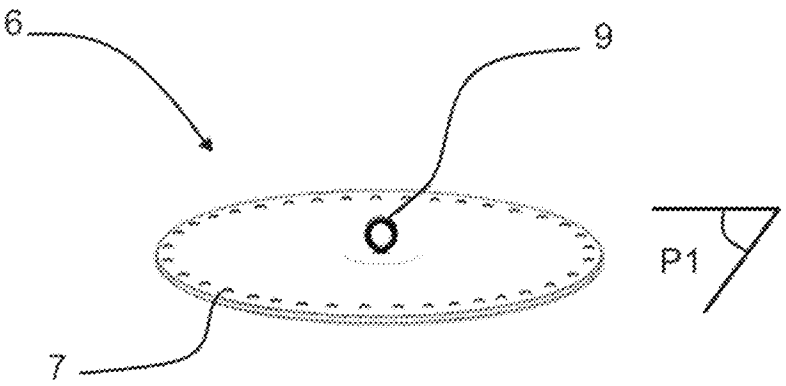
Figure 5:
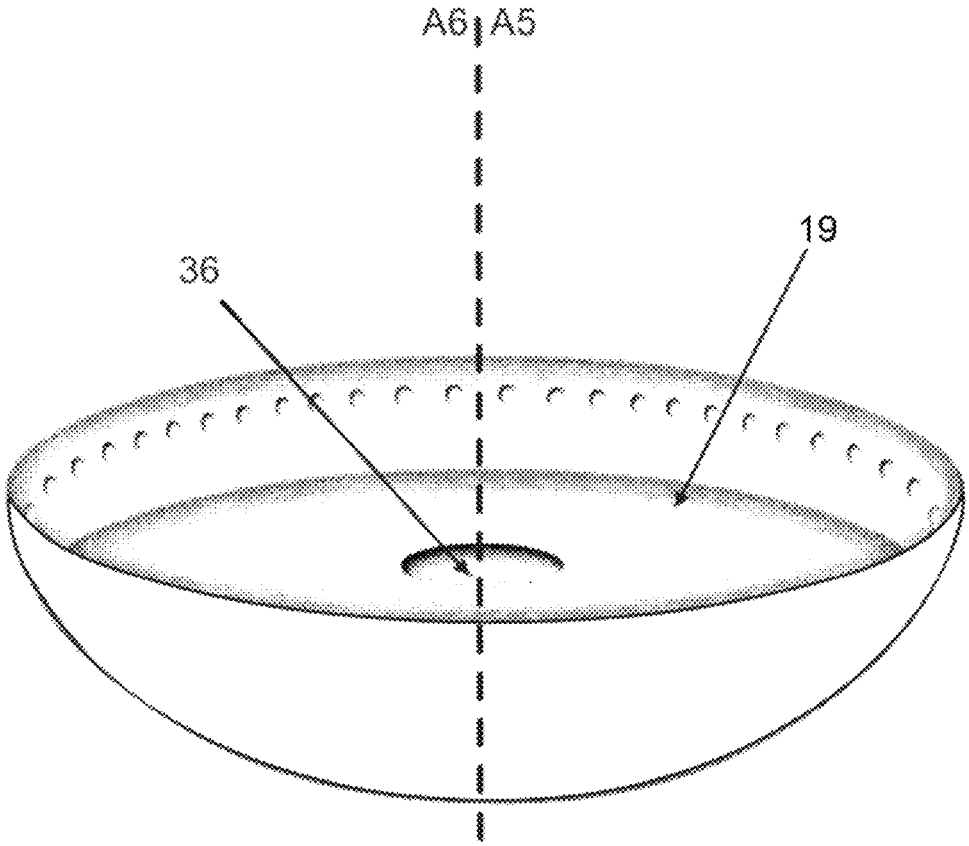
Figure 7:
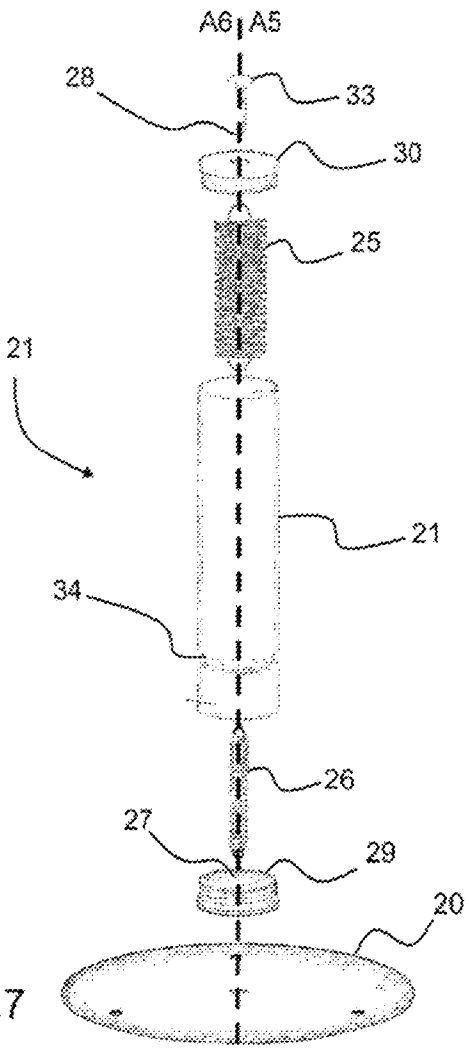
Figure 6:
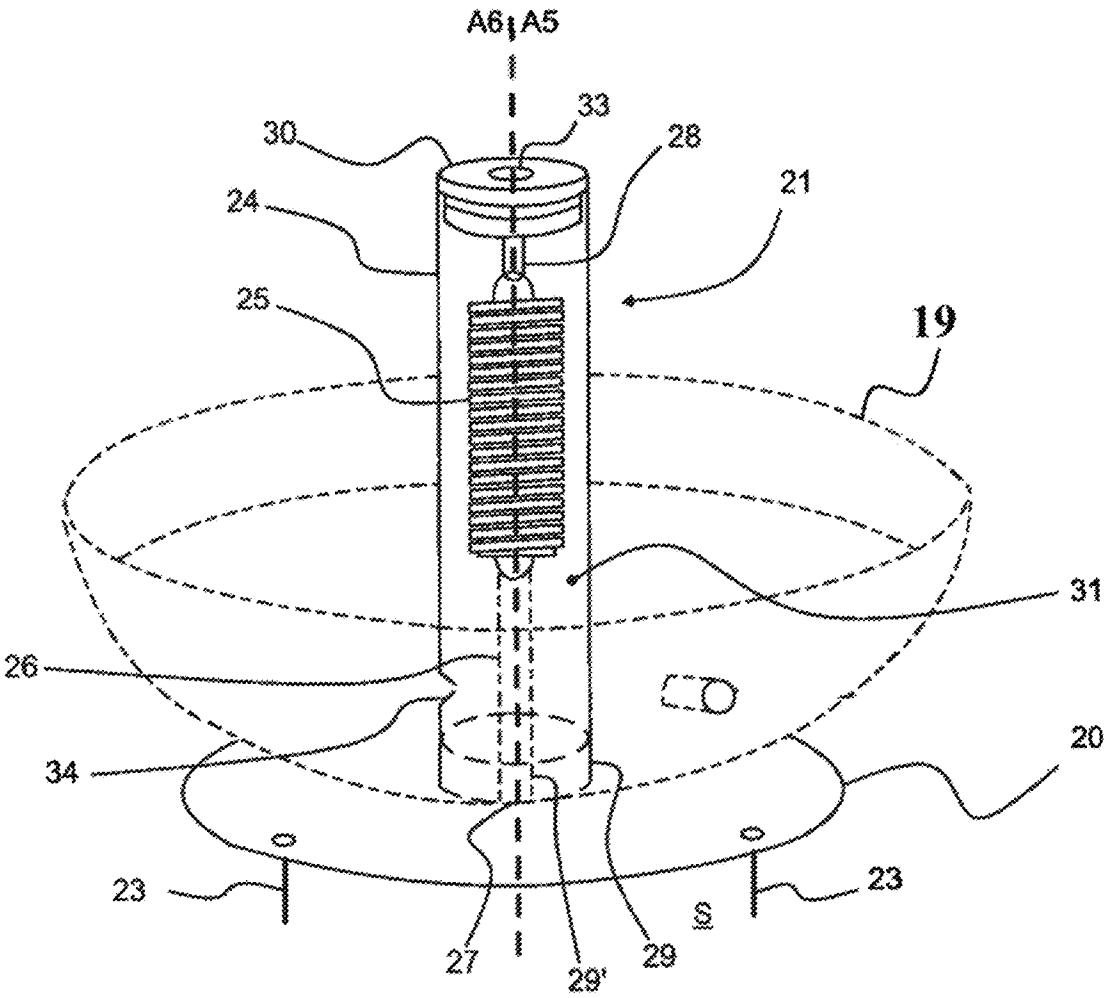
Figure 8:
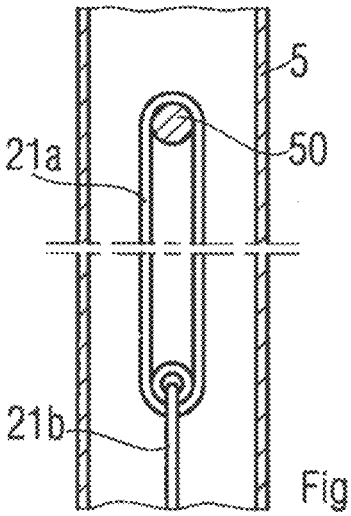
Figure 9:
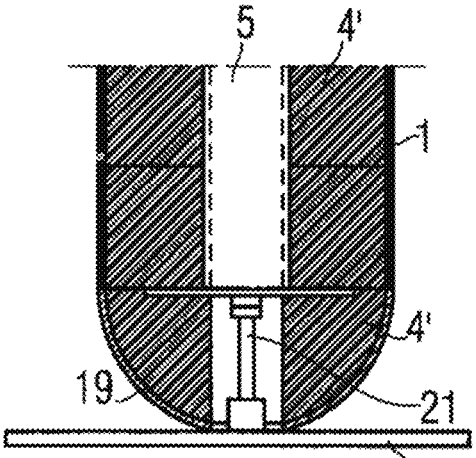
Figure 10:
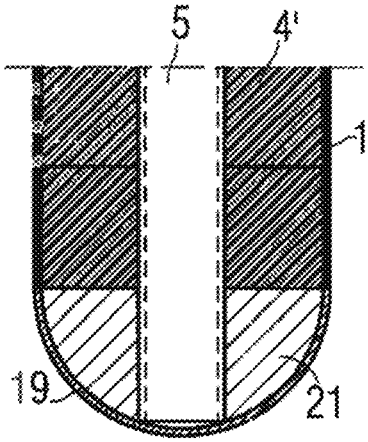
Figure 11:
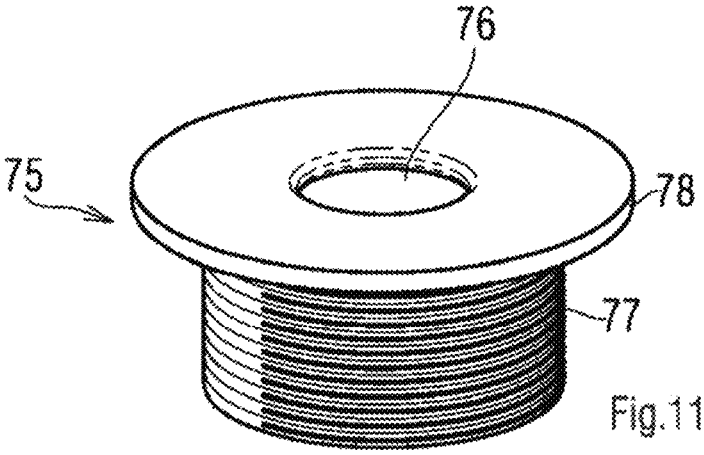
Figure 14:
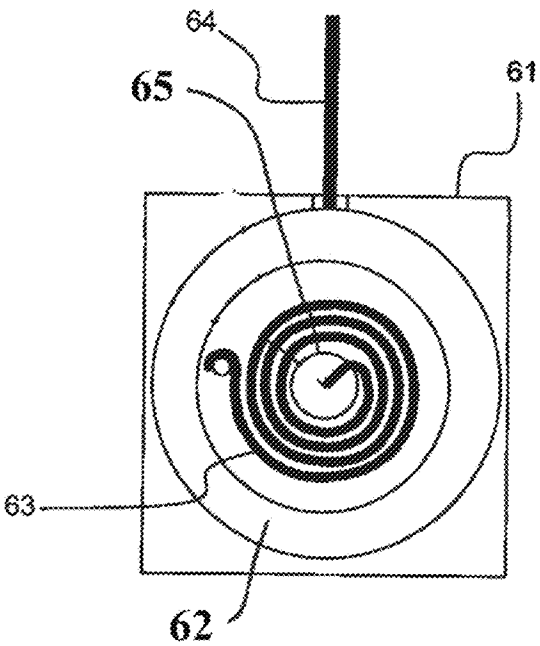
Figure 13:
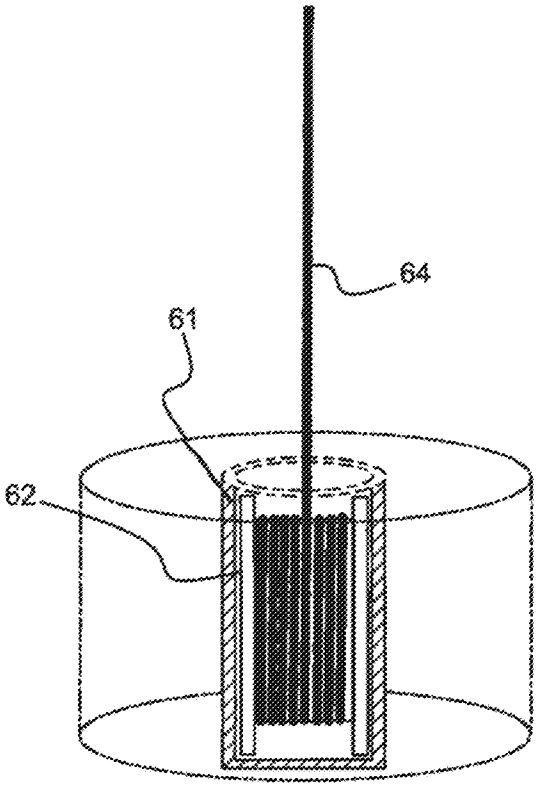
Figure 12:
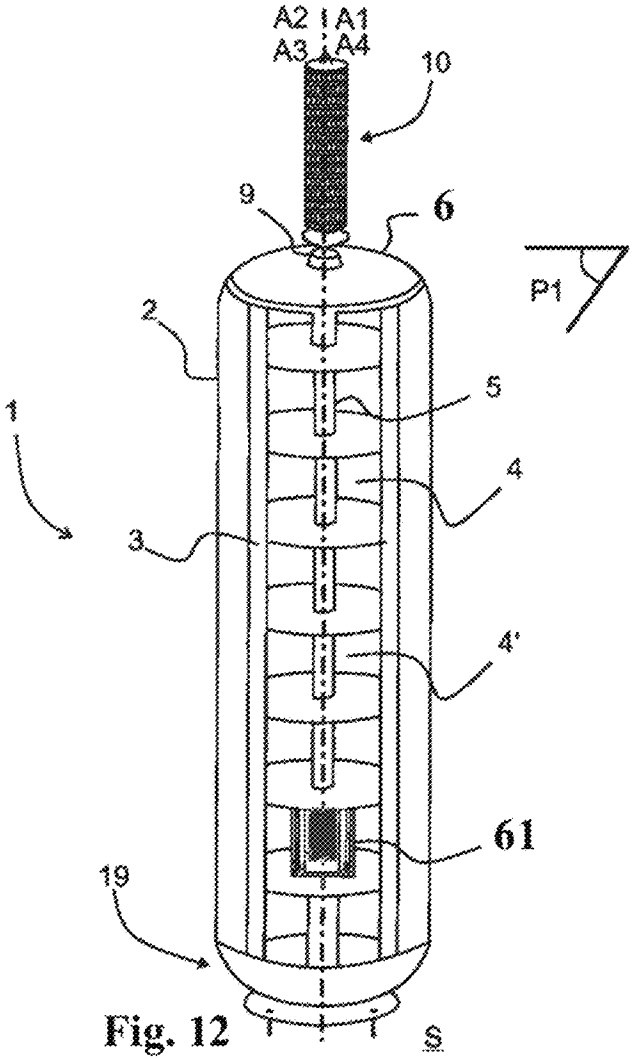
Figure 18:
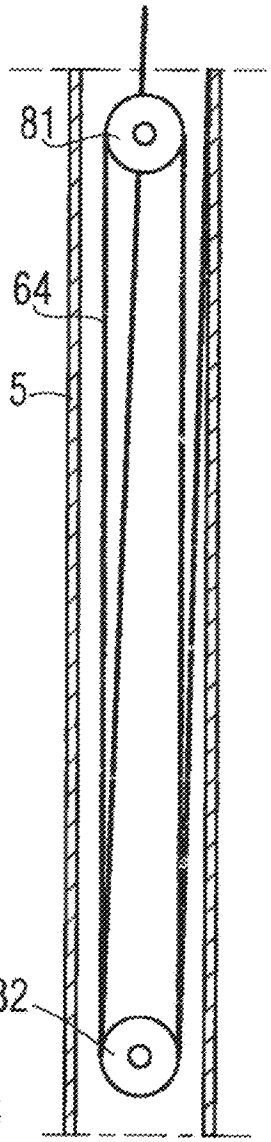
Figure 17:
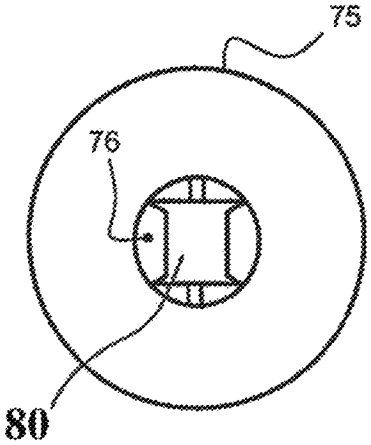
Figure 16:
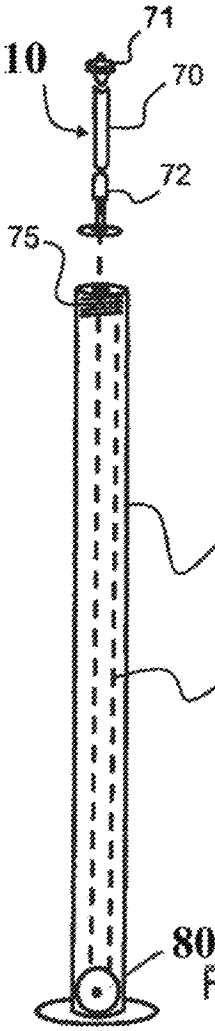
Figure 15:
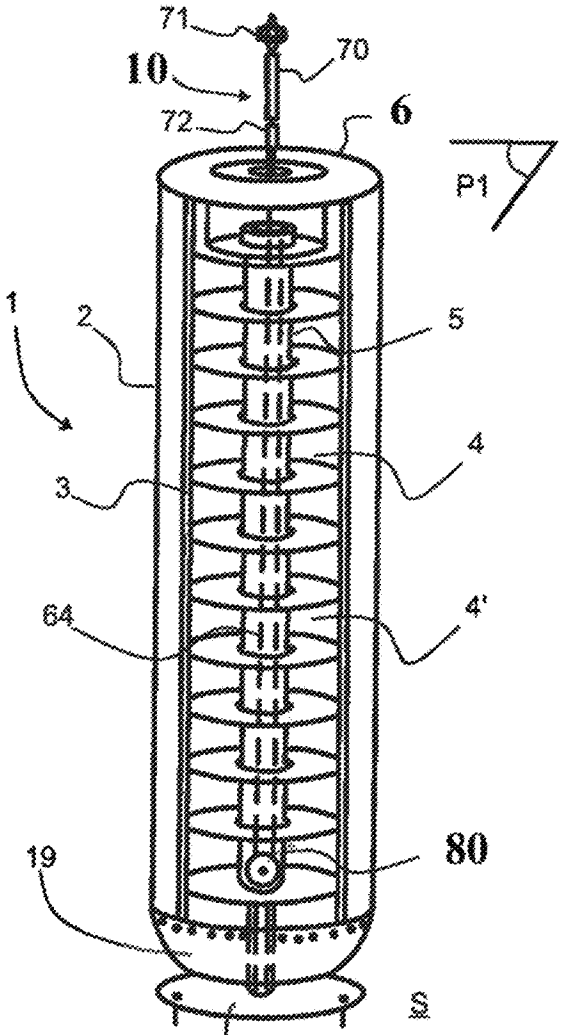
Figure 20:
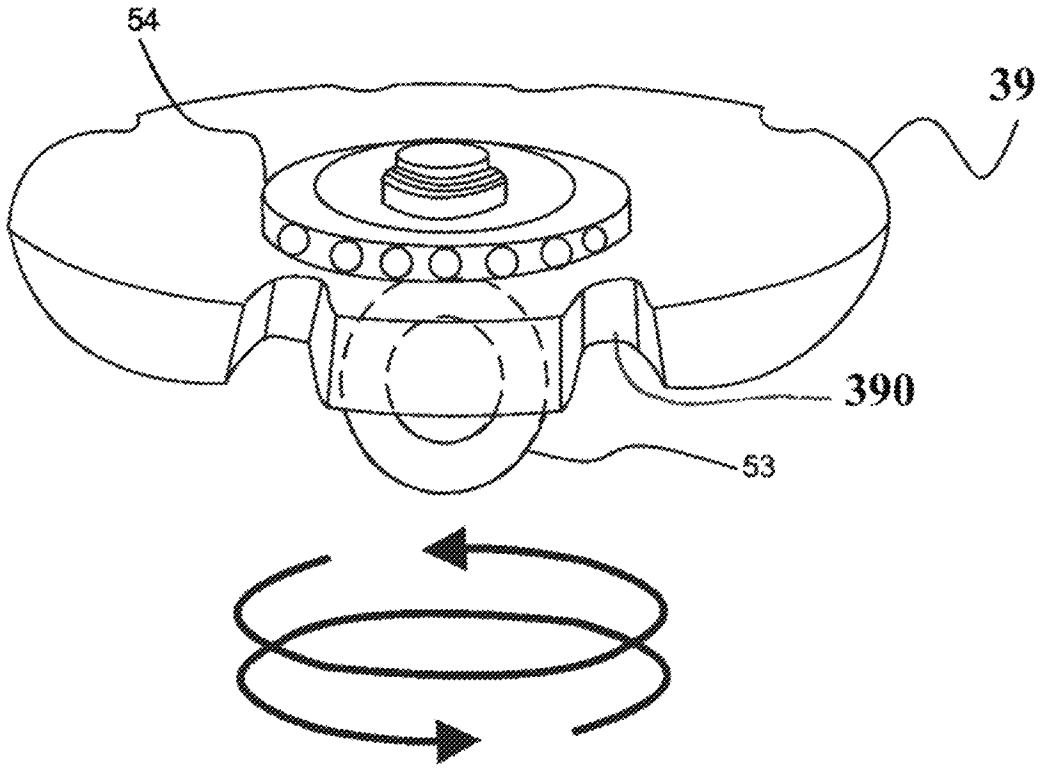
Figure 19:
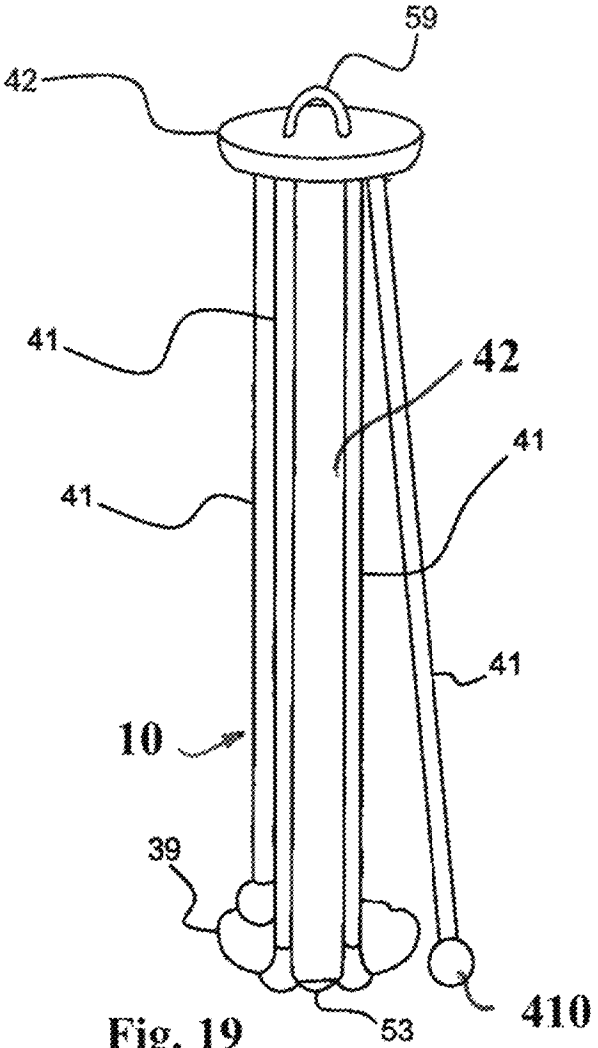
Figure 22:
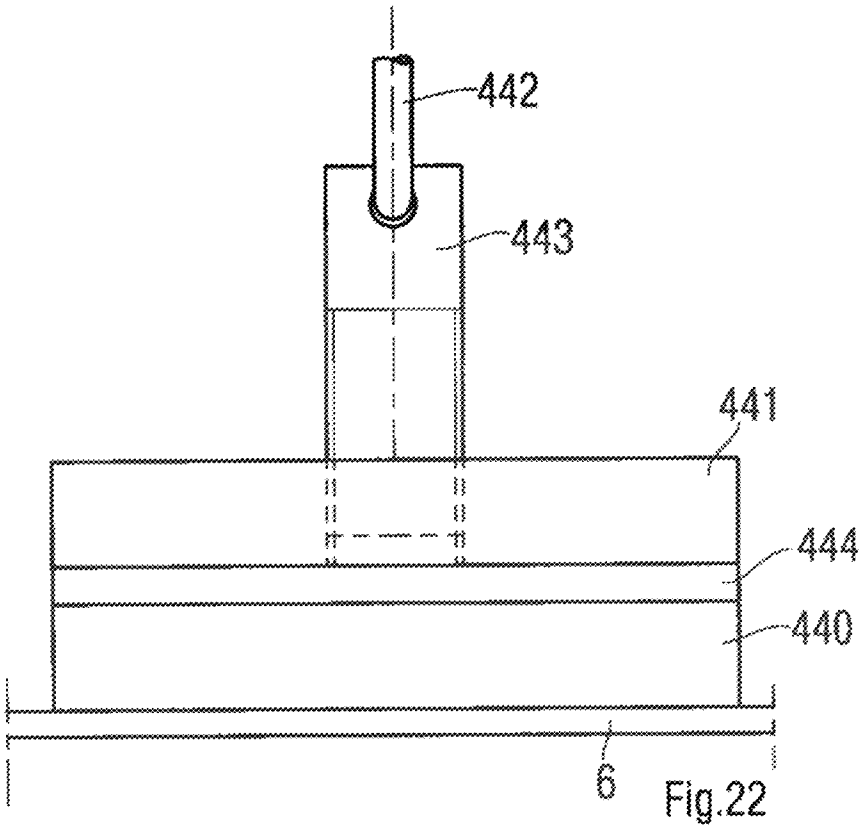
Figure 21:
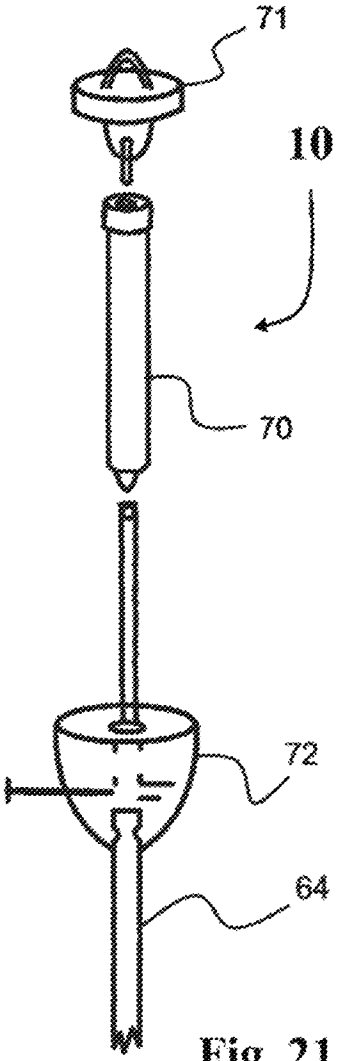
Figure 24:
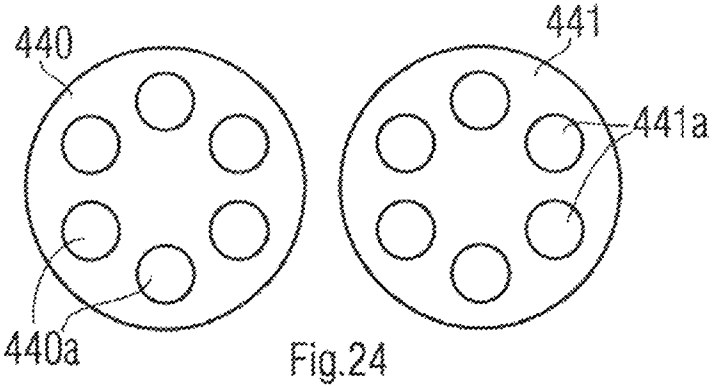
Figure 23:
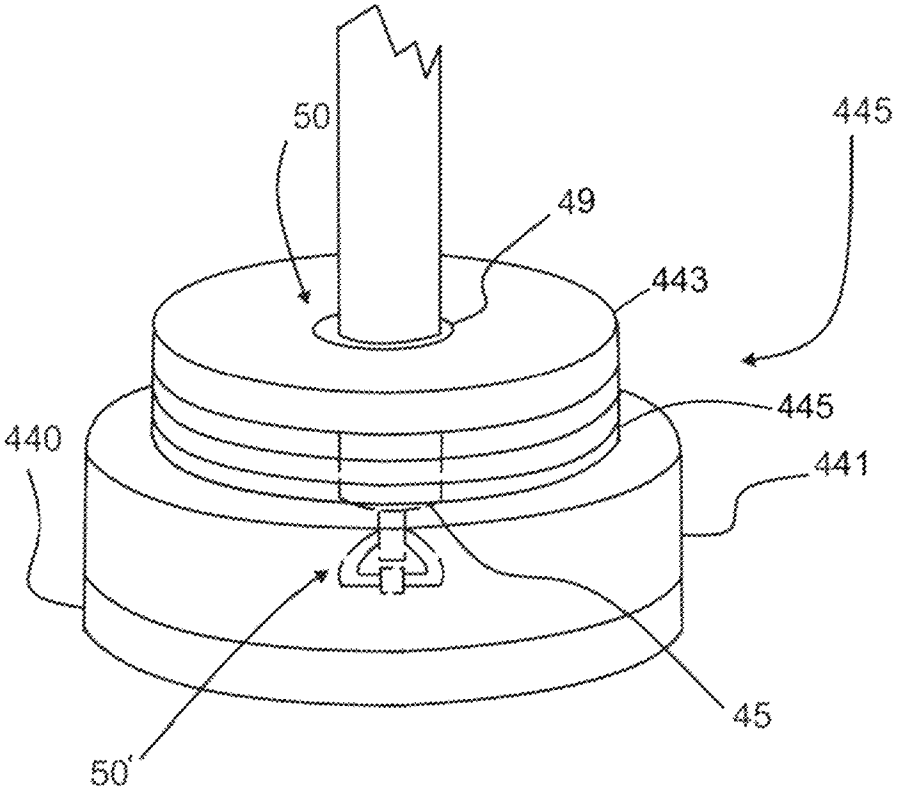
Figure 25:
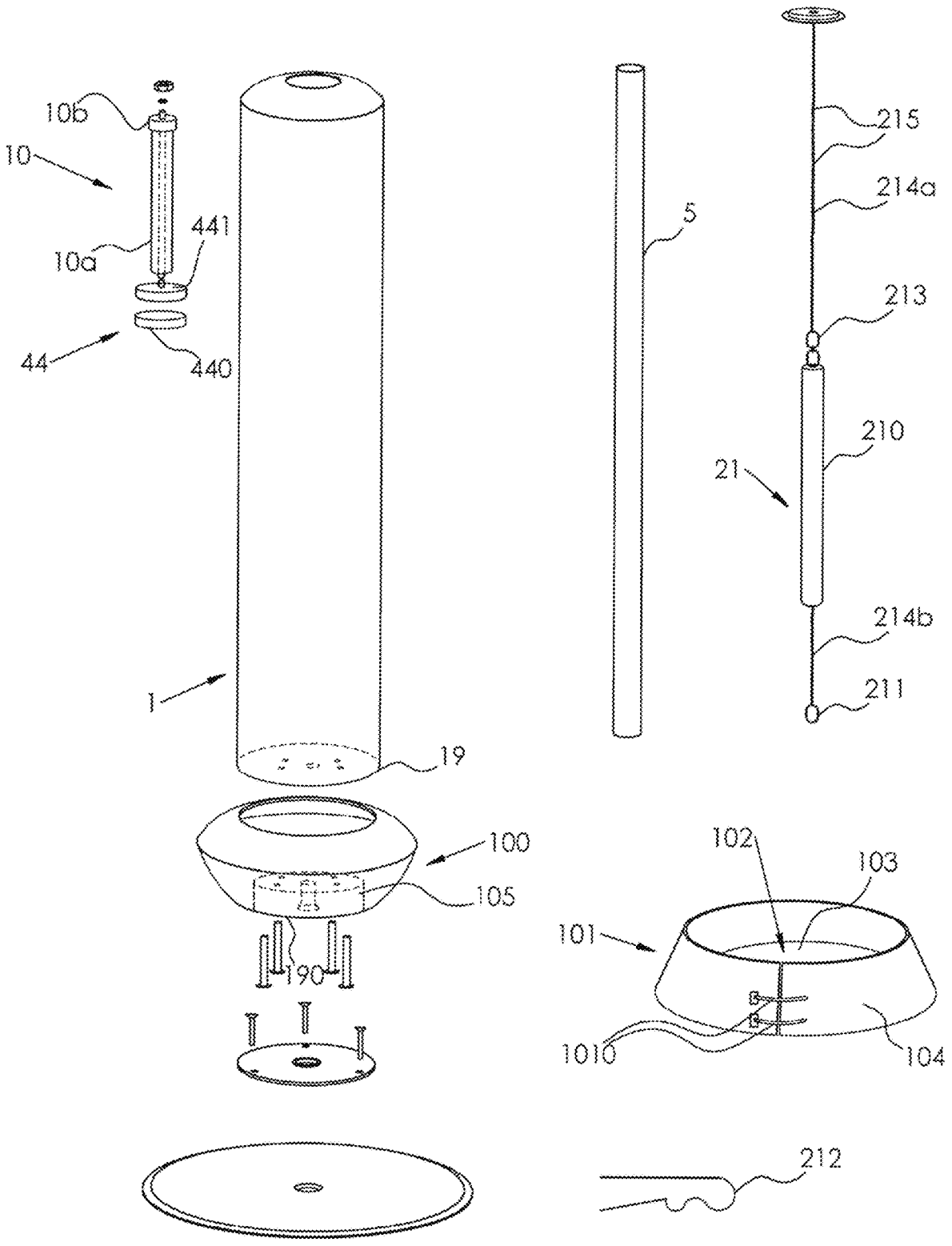
Figure 26:
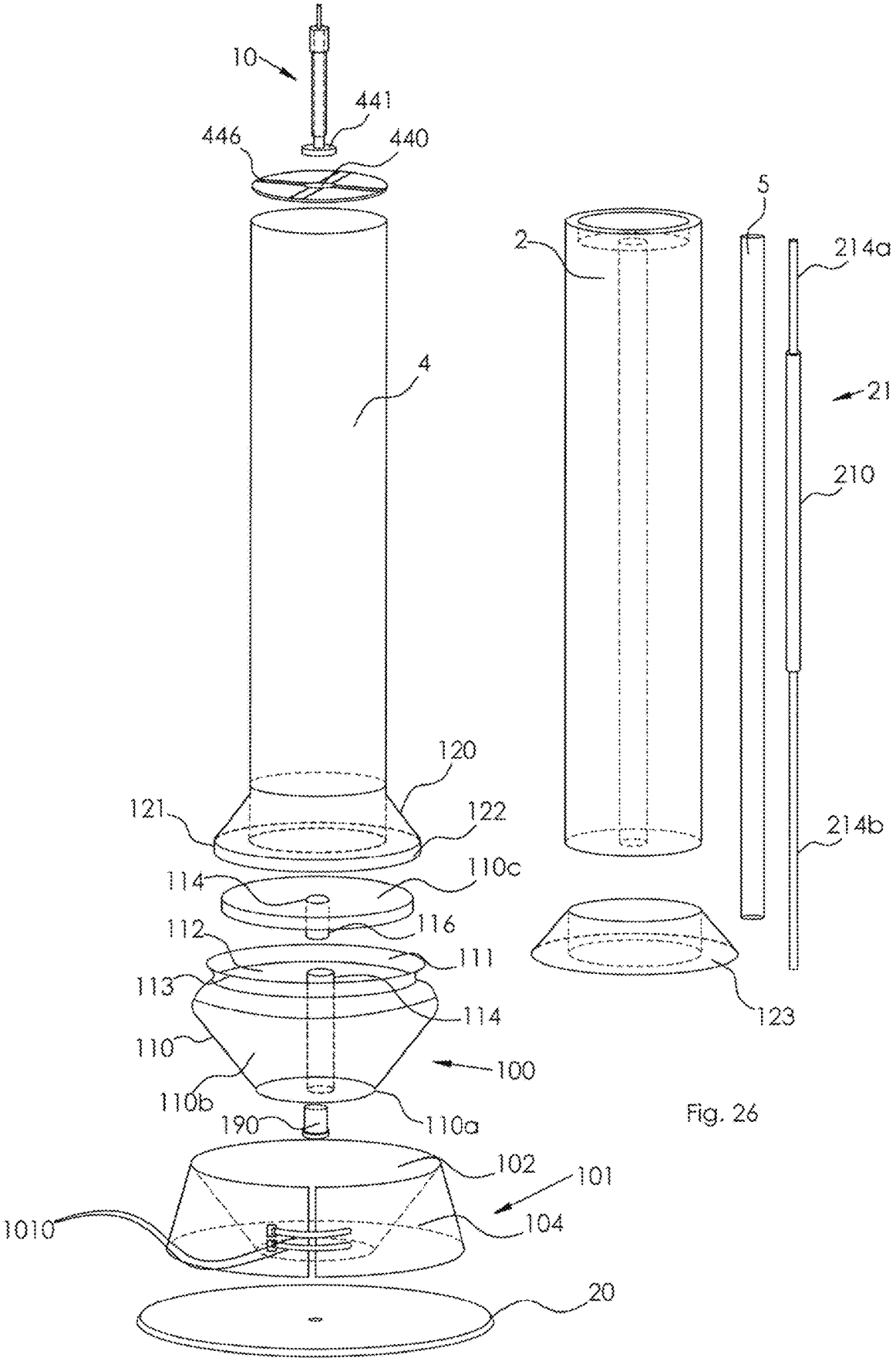
Figure 27:
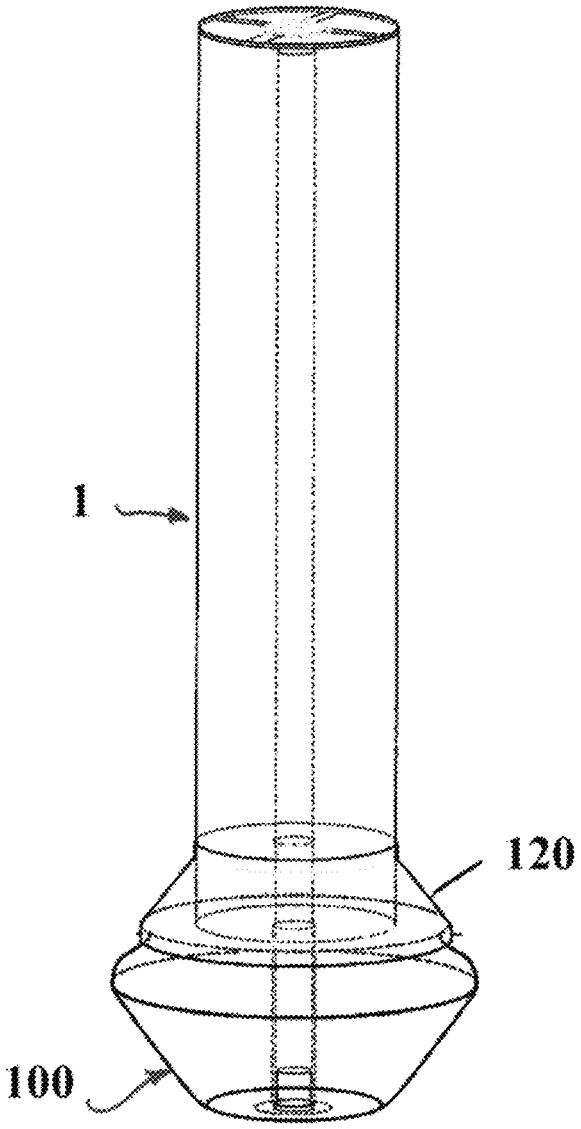
Figure 28:
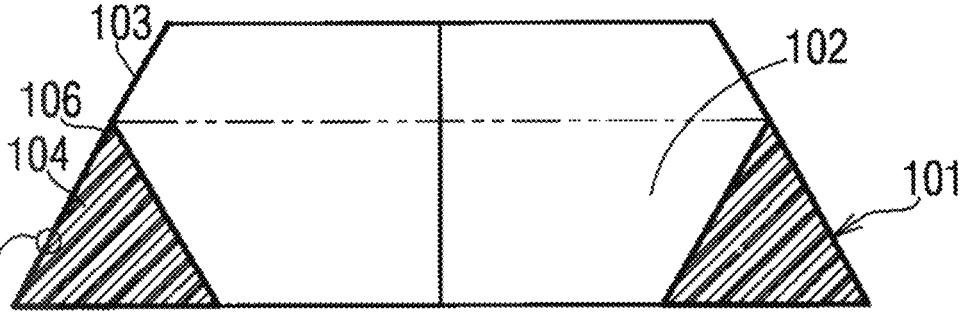
Figure 29:
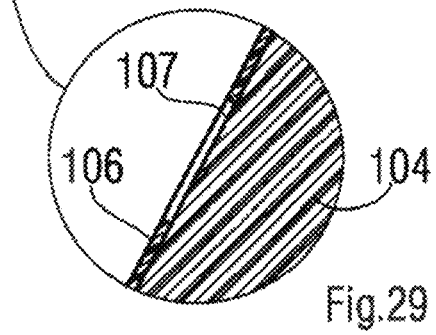

Other advantages, objects and features of the invention will become apparent on reading the description of a preferred embodiment given by way of nonlimiting example with reference to the appended drawings, in which:

FIG. 1 and FIG. 2 are diagrammatic and partially cutaway perspective views of an appliance in accordance with the present invention, FIG. 3 is a diagrammatic perspective view of a top wall of the bag in accordance with a first embodiment, FIG. 4 is a diagrammatic perspective view of an upper closing wall of the bag in accordance with a second embodiment, FIG. 5 is a perspective view of a bottom wall of the bag, FIGS. 6 and 7 are respectively assembled and exploded views of a first means in accordance with a first embodiment for returning the bag to a vertical position, FIG. 8 is a diagrammatic view of the lower return means in accordance with another embodiment, FIG. 9 is a diagrammatic view of the lower return means in accordance with a third embodiment, FIG. 10 is a diagrammatic view of the lower return means in accordance with a fourth embodiment, FIG. 11 is a perspective view of a guide means of a second means for returning the bag to the vertical position, FIGS. 12, 13, 14 are views of a first embodiment of the upper means for returning the bag to the vertical position, FIGS. 15, 16 and 17 are views of a second embodiment of the upper return means, FIG. 18 is a diagrammatic view of a third embodiment of the upper return means, FIGS. 19 and 20 show a first embodiment of an upper retaining means, FIG. 21 shows a second embodiment of an upper retaining means, FIG. 22 is a plan view of a first embodiment of a trigger, FIG. 23 is a perspective view of a second embodiment of a trigger, FIG. 24 shows in detail a trigger in accordance with a third embodiment, FIG. 25 is an exploded view of a bag in accordance with another embodiment, FIG. 26 is an exploded view of a bag in accordance with another embodiment, FIG. 27 is a view of the bag from FIG. 26 when assembled, FIG. 28 is a sectional view of a shock absorber, and FIG. 29 is a view to a larger scale of a detail of the shock absorber from FIG. 28.

DETAILED DESCRIPTION OF THE EMBODIMENTS

As shown, the training appliance in accordance with the invention for practicing combat, contact or grappling sports comprises a punching bag 1, a horizontal base 20 resting on the ground, adapted to be immobilized on the ground S, on which the bottom of the punching bag 1 rests, the whole of the weight of the punching bag 1 being supported this base 20 resting on the ground. A mechanical connection, preferably of the ball-joint type, is established between the base 20 and the bag 1, allowing pivoting movement of the bag 1 in at least one vertical plane and about the point of contact between the bottom of the bag and the base 20. The appliance in accordance with the invention further includes a lower return means 21 of the bag 1 to the vertical position, this return means or first return means 21 acting in the lower part of the bag being adapted to occupy a stable initial state in which the bag 1 is vertical and an unstable final state in which the bag 1 is horizontal and laid on the ground.

The punching bag 1, which is generally of cylindrical shape, comprises an external envelope 2 that consists of a skin, interchangeably natural, such as a leather or the like, or synthetic, such as a plastic material, notably nylon or the like. The external envelope 2 is conformed as a tube defined along a first geometrical axis of revolution A1.

The external envelope 2 houses an internal envelope 3 that is made of a material that imparts a defined geometrical shape to the punching bag 1, notably a cylindrical shape. One such material is a flexible resin or the like, for example. The internal envelope 3 is conformed as a tube defined along a second geometrical axis of revolution A2 that coincides with the first geometrical axis of revolution A1. The internal envelope 3 houses at least one cylindrical shock absorber block 4, forming a filling material, defined along a third geometrical axis of revolution A3 that coincides with the second geometrical axis of revolution A2. The cylindrical shock absorber block 4 is preferably constituted of a cellular material, such as a foam or an analogous elastically deformable material, notably having a high impact strength, in order to revert to an original conformation after a blow has been administered to the punching bag 1 by a user. The foam has a density chosen to impart to the punching bag 1 a better compromise between appropriate weight, mobility and reactivity.

In accordance with a preferred embodiment, the cylindrical shock absorber block 4 is constituted of a plurality of individual cylindrical shock absorbers blocks 4' that are stacked on one another along the third geometrical axis of revolution A3.

The filing material may alternatively be constituted by a fluid, for example air, under pressure, the bag 1 then being constituted by an inflatable enclosure that is sealed for this fluid.

The cylindrical shock absorber block 4 houses a central tube 5 that is preferably elastically deformable in order to be able to flex without risk of breaking. This tube is also of cylindrical conformation defined along a fourth geometrical axis of revolution A4 that coincides with the third axis of revolution A3. This rigid, for example metal, central tube includes at each of its upper and lower ends a mouth constituting an axial opening. The or each return means of the bag to the vertical position is housed at least in part in the tube 5 and is fixed to the latter either directly or via a mechanical connection. The forces returning the bag into position are therefore absorbed by the framework of the bag.

The punching bag 1 and more particularly the internal envelope comprises an upper closing wall 6 and a lower closing wall 19 opposite the former, constituting the bottom of the bag. The tube 5 extends from the upper wall 6 to the bottom wall 19 and is preferably fixed to the latter and constitutes with said walls the framework of the bag. The upper closing wall 6 lies in a disk plane P1 orthogonal to the fourth axis of revolution A4. The upper wall 6 includes at its periphery upper eyelets 7 for passing an upper ring through said upper eyelets 7 and middle eyelets 7' on an upper periphery 8 of the external envelope 2. These arrangements aim to enable easy assembly of the punching bag 1 and fast maintenance operations on the punching bag 1.

In accordance with one embodiment, as shown in FIG. 3, the upper closing wall 6 is a circular disk. The central area of this wall 6 is preferably fixed to the upper end of the tube 5 either directly by any known means or via a fixing element that can receive externally of the bag a first attachment member in the form of a fixing ring 9, seen in FIG. 3. In accordance with this embodiment, the fixing element is, for example, a shouldered threaded bush with its threaded part engaged first in a central hole through the upper wall 6 and then in a threaded part in the upper part of the tube 5. The diameter of the through-hole could be equal to the inside diameter of the tube 5. On screwing in the threaded bush, the shoulder on the latter comes to bear against the upper face of the wall 6. In this way, this wall 6 is clamped between the upper end of the tube and the shoulder of the threaded bush. The ring 9 associated with this bush could include a guiding and retaining shaft and its shaft rotationally engaged in an axial hole through the bush. This shaft, longer than the bush, will receive at the free end, externally of the hole in the bush, a retaining ring for immobilizing the ring 9 in translation relative to said bush. To this ring 9 could be fixed a means for reverting to the vertical position, moreover fixed to a second attachment member fastened to a structure extending above the bag such as a ceiling, boom or the like.

In accordance with another embodiment, as shown in FIG. 4, the upper closing wall 6 is formed of a circular closing plate 12 and an upper closing saucer 11 covering the circular plate 12 and fixed thereto. The closing plate 12 also includes closing eyelets 17 for the passage of said upper ring and the assembly to one another of the closing plate 12, the external envelope 2 and the upper closing disk 6. The upper closing saucer 11 is fixed to the closing plate 12 by screws 14. The threaded shanks of these screws are engaged in holes 15 through the upper saucer 12 and their threaded shanks are also engaged in screw-threaded holes 16 through the closing plate 12.

Finally, the upper saucer 11 and the closing plate 12 each have a central orifice 18, 18' through them for the passage of a guide member 75 (FIG. 11) of a return means, in this instance a cable 64, this means for returning the bag to the vertical position, hereinafter referred to as the second return means, being described hereinafter. In accordance with one embodiment, the guide member 75 is fitted to the upper part of the tube 5, as shown more particularly in FIG. 16.

The wall 19 constituting the bottom of the bag has an axis of revolution A6 that coincides with the fourth geometrical axis of revolution A4.

This wall 19 fixedly receives the central tube 5.

In accordance with a first embodiment as shown in FIG. 5, the bottom wall 19 is convex and adopts the shape of a spherical dome, which spherical dome may be a hemisphere.

The base 20 resting on the ground may be fastened to the ground S by means of at least one screw 23 or by means of any other similar fixing means. This supporting base 20 may be formed by a thin metal plate or by a foam shock absorbing mat. Alternatively, the supporting base 20 is not fixed to the ground, but is held in a fixed position relative to the ground by a ballast weight. In this case, the supporting base 20 advantageously constitutes the top wall of a box receiving the ballast weight. This ballast weight may be constituted by water, sand or other filling material of sufficient density. Any other means known to the person skilled in the art could be used to immobilize the supporting base relative to the ground. For example, the surface of this base resting on the ground could be configured in a non-slip manner.

Alternatively, the base 20, in the form of a metal plate or in the form of a mat could be sufficiently heavy to constitute a ballast weight in itself.

As stated above, the bag 1 is equipped with a lower return means 21 to the vertical position, or first return means, this return means acting in the lower part of the bag.

In accordance with a first embodiment, the or the first return means 21 is fixed on the one hand to the framework of the bag and on the other hand to the supporting ground base 20. This return means 21 is constituted by an elastic member mounted in tension between an attachment point in the tube 5, in the lower or upper area of the latter, and an attachment point in the supporting base 20. This return means 21 is therefore passed through the bottom wall 19 by passing it through a through-hole 36 of the latter. This through-hole 36 communicates with the lower mouth of the tube 5.

In accordance with a first embodiment, as shown in FIGS. 6 and 7, the first return means 21 comprises a main cylinder 24, forming a cage, mounted in the lower part of the central tube 5. This main cylinder receives a first return member 25 in the form of a coil spring and a flexible coupling in the form of a cable 26 providing the mechanical connection between the coil spring 25 and the supporting base 20. The main cylinder 24 has a fifth axis of revolution A5 that coincides with the fourth axis of revolution A4. The first return member 25 and the first cable 26 are conjointly mounted in series between a first anchor point 27 on the supporting ground base 20 and a second anchor point 28 on an upper plug 30 closing the main cylinder. The purpose of the upper plug 30 and a cable-guide plug 29 engaged in the lower part of the main cylinder is to close off a main void 31 inside the main cylinder 24, this main void 31 notably receiving the return member 25. The cable-guide plug 29 has a hole 29' through it for the passage of the first cable 26. The cable-guide plug 29 is fastened to the main cylinder 24 and to the bottom wall 19 of the bag 1. The upper plug 30 is fastened to the main cylinder 24. The second anchor point 28 is more particularly on an anchor screw 33 freely rotatable on itself in a hole through the upper plug 30. The main cylinder 24 includes at its periphery a locking groove 34 that receives one end of a locking screw to fasten to each other the main cylinder 24 and the tube 5 that is not shown in these figures. These arrangements are such that on tackling the punching bag 1 the first cable 26 is able to move through the orifice 29' to enable tilting relative to the supporting base 20, after which the first return member 25 tends to return the first cable 26 to the initial position, i.e. inside the main cylinder 24.

In accordance with another embodiment, as shown in FIG. 8, the first return means 21 is formed of an elongate elastic element constituted of an elastic ring 21*a* fixed to a rod 50 along a diameter of the tube 5 and engaged in radial holes through the latter. Opposite the diametral rod, this elastic ring 210 receives a coupling 21*b* attaching it to the base 20 resting on the ground or, alternatively, is fixed directly to the latter. This elastic ring or coupling 21*b* is engaged in the hole 36 passing through the bottom wall 19.

Alternatively, the elongate elastic element 21*a* takes the form of a coil spring fixed on the one hand to the tube 5 and on the other hand to the base 20, this spring being engaged in the hole 36 through the bottom wall 19. This elongate element could be constituted by an elastic cable.

In accordance with a further embodiment, as shown in FIG. 9, the first return means 21 is fixed on the one hand to the base 20 and on the other hand to an element mounted in the concavity defined by the bottom wall 19, this element possibly being constituted by the lower individual cylindrical block 4', without this being limited on the invention. In this regard, this cylindrical block 4' will then be constituted by a block of foam of appropriate density or any other material having sufficient rigidity to resist the compression action of the first return means 21. In this instance, this lower individual block 4', which has passing through it a hole axially in line with the hole 36 in the bottom wall 19, will receive in said through-hole said first return means, which will essentially be constituted by an elastic cable or a coil spring. The lower end of this cable or spring will be fixed by any known means to the base 20. The upper end of this cable or spring will be fixed to a pivot mechanism carried by a plate bearing on the upper face of the lower elementary block 4'. Such a pivot mechanism, which is known in itself, allows rotation of the bag 1 about the axes A1-A4 relative to the return means 21 and therefore prevents any torsion load on said return means 21.

In accordance with another embodiment, as shown in FIG. 10, the first return means 21 is formed of a ballast weight installed in the lower part of the bag around the central tube 5. The external face of the lower closing wall 19 or bottom wall is more particularly hemispherical and defines an internal volume that is also hemispherical and in which the ballast weight is disposed. The center of mass of the ballast weight is below the center of the equatorial section of the hemispherical volume in order to form a punching bag. In accordance with this embodiment, the bottom wall 19 does not have any hole through it for the passage of the return means 21. Alternatively, the ballast weight of the return means is coupled to an elastic coupling fixed on the one hand to the base 20 and on the other hand to the tube 5. In this instance, the wall 19 includes the hole 36 through which the elastic coupling passes.

Without this being limiting on the invention, the appliance in accordance with the invention advantageously comprises an upper return means or second return means mechanically connected to the framework of the bag 1. This upper return means is fixed to a first attachment member fastened to the bag 1 and more particularly to the framework of said bag and is adapted to be mechanically connected to a second attachment member fastened to a ceiling, a boom or any other structure extending above the bag. This second return means may be mechanically connected to the second attachment member directly or via elements notably providing a mechanical connection between said second return means and said second fixing member.

In accordance with one embodiment, this second return means is essentially formed of an elongate flexible element in the form of a cable 64 housed at least in part in the tube 5 and subjected to internal or external forces tending to shorten the distance between the first and second attachment members and to return said bag to its initial state, namely a vertical position.

In accordance with a first embodiment, not shown, the cable 64 is elastic and lies entirely outside the bag. In this situation, one end of this cable 64 is fixed to the fixing ring 9 that can be seen in FIG. 3. The cable is fastened to the central tube 5 by this ring 9. The other end of the cable will be connected to the second fixing member either directly or, as previously stated, via elements providing a mechanical connection between said cable 64 and said second fixing means.

In accordance with another embodiment, as shown in FIGS. 12 to 18, the member for attaching the cable 64 to the bag is situated inside the tube 5 and, as previously stated, said cable is engaged in a guide member 75 with which the upper part of the tube 5 is equipped, this guide member being engaged in the holes 18 and 18' through the upper saucer 11 and the closing plate 12 of the upper closing wall 6. The guide member 75, in the form of a cylindrical bush (FIG. 11), has an axial hole 76 for the cable 64 to pass through. The guide member includes a screw-thread 77 for mounting it on the central tube 5, for example, to be more precise in a screw-thread in the upper part of the tube.

In accordance with a preferred embodiment, this guide member 75 has a bearing flange 78 in the upper part that comes to bear on the upper end of the tube 5. Moreover, this flange 78 could be screwed to the closing plate 12. Alternatively, the flange 78 will bear on the upper face of the upper saucer 11 and screwed to the latter. These arrangements immobilize the tube 5 and fix it to the upper closing wall 6. The upper and lower edges of the through-hole 76 will each have a chamfer or be rounded to prevent the formation of a sharp edge liable to wear the cable. The same arrangement could be reproduced for the through-holes 18 and 18'.

In accordance with one embodiment, as shown in FIGS. 12, 13, 14, the cable 64 is non-extensible and the member for attaching the cable 64 to the bag, or first bag attachment member, is housed in and fixed to the tube 5. This attachment member is the drum 62 of a winder with a return spring mounted in and fixed to said tube 5. To be more precise, the winder comprises a casing 61 fixed to the tube 5 in which the drum 62 is mounted to rotate on an axle 65 carried by the casing. The return spring 63 takes the form of a spiral leaf spring.

The spring 63 is mounted between the axle 65 and the drum 62 to exert a return torque on the latter to urge the drum toward an initial angular position. To be more precise, the return spring wound around and fixed to the axle 65 at one end is fixed at its other end to the drum 62.

The winder may be mounted in the upper part of the tube 5 or, in an alternative embodiment, in a lower part immediately above the first return means 21.

In accordance with another embodiment, as shown in FIGS. 15 to 18, the cable 64 of the second return means is elastic over its entire length or over a fraction thereof. In accordance with this embodiment, one end of the cable 64, inside the tube 5, is fixed in the upper part of said tube 5 and is wound onto the sheave of a lower pulley 80 the yoke of which is fixedly mounted in the lower part of the tube (FIGS. 16, 17).

In accordance with an alternative embodiment (FIG. 18), the cable 64 is wound onto the sheave of at least one upper pulley 81 that is mounted in the upper part of the tube 5 and the yoke of which is fixed thereto and onto the sheaves of at least one lower pulley 82 the yoke of which is fixedly mounted in the lower part of the tube 5.

In the embodiments described above, the yoke of the lower pulley 80, 82 of the second elastic return means is fixed to the central tube 5, but in accordance with a variant embodiment the first return means, in the form of an elastic member, is fixed to the lower pulley 80, 82 of the second elastic return means, this second pulley being mounted to move in translation in the central tube 5.

The corresponding end of the cable 64 may be fixed directly to the second fixing means or alternatively there is mechanically disposed between the member for attachment to the ceiling or second attachment member and the corresponding end of the cable 64 of the second return means, or upper return means, an upper retaining system 10 that is elastically deformable in the lengthwise direction. This upper retaining system 10 constitutes the mechanical connecting element or one of the mechanical connecting elements referred to above between the cable 64 and the second fixing member. This upper retaining system 10 also serves as a return means and completes and/or modifies the action of the cable 64. It may also be used as upper return means, without the cable 64 and the return elements associated therewith. This upper retaining system 10 includes a ring for fixing it to the second attachment member. Clearly in this instance the cable is not connected directly to the second attachment member, but is instead connected to the latter via the upper retaining system 10.

In accordance with a first embodiment, as shown in FIGS. 1, 2, 12, 19, 20, the upper retaining system 10 comprises a central elastic element in the form of a cable 40 and a plurality of peripheral elastic elements in the form of cables 41. As can be seen these various elements 40, 41 are parallel to one another and arranged in bundles and their ends are fixed to a spaced upper plate 42 and lower plate 39. The peripheral elastic members 41 are advantageously fixed individually and detachably to at least one of the two plates so as to make it possible to adjust the stiffness of the upper retaining system. In accordance with the embodiment shown in FIG. 19, the peripheral elements 41 are fixed individually and detachably to the lower plate 39 and to this end the lower part of each element 41 includes an enlarged portion 410 while the lower plate 39 includes radial slots 390 open at the periphery. Each peripheral element 41 is fixed to the plate 39 by engaging it in the corresponding radial slot, the enlarged portion 410 coming to bear against the lower face of the plate 39. To accommodate the enlarged portion of each element 41, the lower face of the plate could include a series of recessed imprints communicating with the corresponding radial slot 390.

As can be seen in FIG. 20, the lower plate 39 is equipped with a fixing ring 53 of the corresponding end of the cable 64. This fixing ring 53 lies under the plate 39 and includes a radial journal by means of which it is engaged in the internal race of a ball bearing 54 mounted in a central housing in the plate 39.

The upper plate 42 has a ring 59 for fixing it to the second fixing member.

In accordance with a second embodiment, as shown in FIGS. 15, 16, 21, this upper retaining system 10 is constituted by a coil spring 70 and includes a connecting assembly 72 to which are fixed on the one hand the corresponding end of the cable 64 and on the other hand the lower end of the coil spring 70. This retaining system further includes a pivot mechanism 71 fixed to the upper end of the coil spring and adapted to be fixed to the second fixing member. The pivot mechanism 71 allows the punching bag 1 to rotate 360° on itself. The pivot mechanism 71 is preferably constituted of a journal-shackle comprising a shackle and a journal.

There is advantageously disposed between the upper retaining system 10 and the framework of the bag a means adapted to fix a mechanical triggering threshold value below which the upper retaining system 10 is fixed to the framework of the stack and above which the lower end of said retaining system 10 is detached from the framework.

This means is constituted by a trigger 44 (FIGS. 22, 23, 24) formed of at least two elements 440, 441 joined to one other in a separable manner, the first 440 of which is mechanically connected to the framework of the bag 1 and the second 441 of which is connected to the retaining system 10, said elements being adapted to be urged mechanically away from one another. These trigger elements remain inter-engaged with one another if the intensity of the mechanical loading that tends to separate them is below the triggering threshold value; on the other hand, they are separated from one another if the intensity of said mechanical loading is above the triggering threshold value.

In accordance with a first embodiment the bag includes two upper retaining means of which one includes the cable 64 and the other is constituted by the upper retaining means 10. In accordance with this embodiment, the cable 64 is fixed to the second element 441 of the trigger. Accordingly, below the triggering threshold only the upper retaining means 10 is loaded in extension and on the other hand above this value the two elements 440, 441 of the trigger 44 are separated from each other and the cable 64 is also loaded in traction.

In accordance with another embodiment, as shown in FIG. 25, the bag includes only one upper retaining means, namely the upper retaining means 10, and the second element of the trigger receives fixedly only the lower end of said retaining means 10. In accordance with this embodiment, if the trigger threshold is crossed, the upper retaining means 10 is suddenly separated from the bag 1.

In accordance with embodiments as shown in FIGS. 22, 2 and 24, the first element 440 of the trigger 441 is formed either of a wall that may be constituted of a magnetizable material, for example steel, or a magnetized wall, or a magnet. This first element 440 is fixed to or forms part of the top wall 6 of the bag 1. The second element 441 is constituted by a magnet magnetically coupled with the first element 440, said magnet 441 being fixed to the lower end of the upper retaining system 10.

The magnet 441 additionally includes a projecting lever in the form of a rigid rod 443 to the free end of which the upper retaining system 10 is fixed either directly or via a flexible coupling 442. The projection that said rod or lever forms on the magnet 441 is advantageously adjustable in height in order to form the adjustable lever arm. To this end, the rod 443 is threaded and screwed into a threaded hole in the magnet 441. Screwing in or unscrewing the rod 442 adjusts the length of the lever arm that the projecting part of said rod forms.

The force of magnetic attraction between the two elements 440, 441 of the trigger may be adjusted by inserting one or more shims 444, for example made of a nonmagnetic material of appropriate thickness. This shim or these shims are placed between the magnet 441 and the magnetizable wall 440.

If the bag is equipped with two upper return means one of which is formed by the upper retaining means and the other of which includes a cable 64, the latter will be fixed by the end of the cable to the first element 440, namely the magnet, via a pivot connection known in itself.

In accordance with another embodiment, as shown in FIG. 23, the first element 440 in the form of a magnet is fixed to the top wall 6 of the bag 1 and has the second element 441 on top of it, the latter being tubular and made of a magnetizable material, for example steel, or a magnetized material or being a magnet. This second element 441 includes a thread 445 into which is screwed a tubular element 443 forming a lever, the latter including to this end an appropriate thread. Screwing the lever 443 into the former adjusts the value of the lever arm that the projecting part of the lever 443 forms relative to the second element 441 of the trigger and consequently the value of the triggering threshold. The force of magnetic attraction between the magnet 440 and the second element 441 could be adjusted by inserting at least one nonmagnetic shim of appropriate thickness.

As stated above, if the bag is equipped with two upper return means one of which is formed by the upper retaining means and the other of which includes a cable 64, this latter retaining means will be fixed by the end of the cable 64 to the second element 441, namely the magnet, via a pivot connection 50' known in itself. This pivot mechanism enables the punching bag 1 to rotate 360° on itself without creating any torsion load on the cable 64.

Finally, the lever 443 also comprises a cable guide 49 in a central part 50. This cable guide, passing through it, constitutes a passage for a coupling providing a mechanical connection between a central point 45 of the first element 440 and the upper retaining system 10.

In accordance with another preferred embodiment (FIG. 24), the first and second elements 440, 441 of the trigger are each formed by a plurality of magnets 440*a*, 441*a* disposed in an appropriate mount, made of aluminum, for example, or any other nonmagnetic material.

Each mount takes the form of a thick disk having two large plane faces of which one face, the bearing face, is adapted to come into contact with the large bearing face of the mount of the other element of the trigger. Cylindrical blind holes are produced in the mount from the large bearing face. The cylindrical magnets 440*a*, 441*a* have dimensions equal to those of the holes and are fixedly engaged therein so as to be flush with the bearing face of the mount. The poles of each magnet 440*a*, 441*a* respectively correspond to their two plane end faces. The magnets 440*a*, 441*a* of each element 440, 441 of the trigger 44 are disposed opposite the magnets of the other element in order to create mutual magnetic attraction between said two elements 440, 441. The advantage of such an arrangement lies in the self-centering of the two elements 440, 441 when mutually attracted.

FIGS. 25 and 26 show other embodiments of the bag 1 according to the invention. The lower closing wall 19 takes the form of a disk to which the internal and external envelopes 2, 3 are fixed.

As can be seen in FIG. 25, the lower part of the bag 1 includes a ballasting means 100 in the form of a peripheral covering 100*a*, preferably of dense foam, having substantially the form of a spherical segment and a ballast weight 105 buried in the foam constituting the peripheral covering. This ballast weight is advantageously constituted of a thick cast iron disk in order to form a punching bag. This cast iron ballast weight 105 is screwed to the lower closing wall 19. It also has an axial threaded hole passing through it into which is screwed a tubular guide sleeve 190 providing a passage for the first return means 21.

FIG. 26 is an exploded view of another embodiment of a punching bag in accordance with the invention. It can be seen that the lower part of the bag again includes a ballasting means 100. This ballasting means 100, in accordance with this embodiment, is formed of a rigid shell 110 defining an internal chamber 111 in which is disposed a solid, granular or liquid ballasting material 112.

The shell 110 has a horizontal bottom wall 110*a*, an envelope wall or lateral wall 110*b* and a horizontal top wall 110*c*, these various walls defining the internal chamber 111 of the shell. The bottom wall 19 of the bag 1 bears on the top wall 110*c* of the shell 110.

The internal chamber 111 of the shell 110 advantageously has an opening at the top to receive the ballasting material. This top opening is fitted with a closing cover in order to provide a sealed closure. This closing cover then constitutes the top wall 110C of the shell 110.

The cover 110C is preferably screwed into a thread in the top opening of the shell 110 constituting the ballasting means 100.

In accordance with the embodiment that is the subject of FIG. 26, the lower part of the bag includes a skirt 120 for protecting it and fixing it to the ballasting means 100. This protecting skirt 120, which is made of a flexible material, surrounds the lower part of the bag and its upper part is sewn to said bag, for example. This protecting skirt 120 widens downwardly and includes along its bottom border means for fixing it to the ballasting means 100. In the embodiment, this fixing means is constituted by a hem 121 formed along the lower border of the skirt 120 and a drawstring 122 that slides in the hem and by a continuous groove 113 formed in the upper part of the envelope wall 110*b* of the shell 110, said groove receiving the eyelet 121 of the skirt 120. The lower part of the skirt 120 is therefore fixed to the ballasting means 100 by tightening the drawstring into this groove 113. It should be noted that the effect of fixing by means of the drawstring is to tension the skirt 120 and that because of this tensioning the bottom wall 19 of the bag is pressed against the top wall 110*c* of the shell 110.

A filling foam 123 could advantageously be disposed between the skirt 120 and the lower part of the bag 1. This filling foam will be elastically deformable so as to be able to be deformed by mechanically loading it and resume its initial shape as soon as the mechanical loading ceases. Such an arrangement is able to absorb impacts that the skirt may suffer and thereby strengthen the protection of the lower part of the bag against impacts.

In accordance with the embodiment shown, the skirt 120 defines a frustoconical volume, the larger base of this volume corresponding to the lower border of said skirt.

In accordance with one embodiment, the ballasting means has a vertical perforation passing completely through it along its vertical axis of symmetry to provide a passage for the first elastic return means 21. In the embodiment, this perforation is constituted by a first hole through the bottom wall 110*a* of the shell 110, at the centre of this wall, by the internal hole of a first vertical tube 114 inside the shell 110 and fixed to the bottom wall 110*a* axially in line with the first through-hole and by a second hole 115 through the top wall 110*c* of the shell 110 at the centre of that wall. This second hole 115 is preferably extended in the shell 110 by the internal hole of a second vertical tube 116 fixed to the top wall 110*c* of the shell 110 in axial alignment with the second hole 115, this second vertical tube 116 cooperating sleeving fashion with the first tube 114. The lower part of the first tube advantageously receives a tubular guide sleeve 190 through which the first return means 21 passes.

In accordance with the embodiment that is the subject of FIG. 26, the shell defines a substantially frustoconical volume the smaller base of which corresponds to the bottom wall 110*a* of the shell.

In both its embodiments, the ballasting means 100 is additionally mounted in a pivoting manner in a shock absorber 101 fixed to or placed on the base 20 or alternatively placed on the ground itself. This shock absorber 101 is disposed around and in contact with the ballasting means 100. This shock absorber 101 is made of low-density foam. This foam is elastically deformable so as to be able to be deformed by a mechanical loading and to resume its initial shape as soon as this mechanical loading ceases.

The shock absorber 101 is formed by an envelope wall 104 extending in a circle. This envelope wall 104 defines an open housing 102 to receive the ballasting means 100. The shape of this housing 102 is preferably substantially complementary to that of the covering or the shell of the ballasting means. This envelope wall 104 has a lower bearing face and an upper border. The thickness of this envelope wall 104, measured horizontally, preferably decreases from the bearing face toward the upper border. Such an arrangement facilitates the elastic deformation of the upper part of the envelope wall 104 caused by the pivoting movement of the bag 1 and is of a kind to damp this movement to prevent the bag falling to the ground because of the blows absorbed.

The envelope wall 104 of the shock absorber 101 preferably forms an open ring in the sense that it has two opposite ends facing each other. In this embodiment, the shock absorber 101 includes junction elements 1010 in the form of straps for joining said two ends together and closing the ring thus formed. Each strap will advantageously be constituted by a self-gripping strip of the kind identified by the trademark "Velcro". One of the two ends of each strap is sewn to one of the two end zones of the shock absorber 101 and is adapted to cooperate with a self-gripping element sewn to the other end zone of the shock absorber to fix it. This arrangement of the shock absorber 101 in the form of an open ring allows easy and fast fitting of this shock absorber around the ballasting means 100 without having to manipulate either the bag 1 or said ballasting means 100.

The shock absorber 101 as described preferably has a skin 106 for protecting the low-density foam. This protecting skin 106 has exhaust orifices 107 of calibrated size through it (FIG. 29). These orifices 107 of calibrated size enable escape of air contained in the pores of the foam when the shock absorber 101 is compressed. Such an arrangement prevents the shock absorber 101 bursting because of an excessive internal air pressure. Thanks to the orifices of calibrated size, it also makes it possible to reinforce the shock absorbing function of the shock absorber. A closure member could be associated with each hole of calibrated size for adjusting the shock absorbing effect. This member could be constituted by a self-gripping strip such as that known under the trademark "Velcro".

As can be seen in FIG. 28, the shock absorber 101 advantageously has an upper lip 103 adapted to cover and to bear on the upper face of the ballasting means 100. Such an arrangement retains the shock absorber 101 and the ballasting means 100 relative to each other.

The first return means 21 as shown in FIGS. 25 and 26 comprises an elastic member 210 and upper and lower non-extensible couplings 214*a* and 214*b* respectively fixed to the top and bottom of the elastic member. The lower part of the coupling 214*b* is engaged in the tubular sleeve 190 and where applicable in a threaded tubular bush adapted to be screwed into a blind thread or a thread extending right through the base 20 that rests on the ground. The lower coupling 214*b* is fixed to the threaded bush by means of a retaining pin 212 (FIG. 25). To this end, the lower coupling 214*b* receives in its lower part a fixture 211 having a diametral hole through it receiving the retaining pin 212 under the threaded bush. Because of the tension in the elastic member 210, the retaining pin 212 comes to bear against the lower face of the threaded bush. Such an arrangement makes it possible to facilitate the fixing of the bag to the base 20 that rests on the ground. To this end the elastic member 210 is slackened and the pin is inserted into the fixture 211, under the threaded bush. This threaded bush is independent of the bottom wall 19 of the bag and can then be screwed into the thread of the base without having to manipulate the bag. Alternatively, the lower coupling 210*b* could be fixed to a looped strap fixed by its two ends to a plate adapted to be disposed under the base 20, the looped strap then being engaged in the hole through the base 20. Alternatively, the plate is fixed to the ground.

The coupling 214*a* is preferably fixed to the elastic member 210 by means of a swivel 213. The coupling 214*a* is preferably fixed to the elastic member 210 by means of a swivel 213. This coupling 214*a*, which may be used to tension the elastic member 210, is preferably fixed to the upper wall 6 and engaged in a hole through the upper wall 6 and above that wall receives a cable clip forming an abutment. Because of the tension imparted to the elastic member 210, the cable clip comes to bear against the upper face of the upper wall 6 of the bag 1. Alternatively, the hole through the upper wall 6 will be configured so as to have an area of reduced size centered relative to the longitudinal axis of the bag and an enlarged area adjoining the area of reduced size. With such an arrangement, the tensioning coupling 214*a* includes a series of equidistant knots 215 or other portions of increased thickness sliding freely in the enlarged area of the hole through the wall 6. The area of the hole of reduced size has a diameter slightly greater than that of the coupling 214*a* but much less than that of the increased thickness that each knot forms. Accordingly, for the purposes of tensioning, the coupling 214*a* is engaged in the area of reduced size and the knot 215 immediately above the top wall is caused by the tension in the elastic member 210 to come to bear against the border of the area of reduced size of the through-hole.

Such a bag may therefore be used with no second return means, but in accordance with a variant embodiment as shown in FIGS. 25, 26, 27, is provided with a second return means formed exclusively of an upper retaining system 10 as described above in its various embodiments. This retaining system 10 may be fixed directly to the bag, for example to the ring 9 that can be seen in FIGS. 1 and 3, but in accordance with a preferred embodiment this retaining system 10 is fixed to the bag 1 by way of a trigger 44 as described above in its various embodiments.

In FIGS. 26 and 27 it can be seen that the element 440 of the trigger 44 is fixed to an orientable mount fixed in the upper part of the bag that allows orientation of the trigger in the direction of the force applied. This mount is advantageously constituted by a set of horizontal straps 446, which may be elastic, disposed in a cross and fixed by their ends to the upper part of the bag, notably to the upper part of the external envelope 2. The element 440 is fixed to the crossing point of the straps by any known means.

In accordance with another embodiment the elastic member of the upper retaining system 10 is disposed in a synthetic material sheath 10*a* that is elastically deformable in bending. This sheath 10*a* is rigidly fixed to an upper plate 10*b* adapted to be rigidly fixed to a ceiling, a boom or like structure. Such an arrangement enables the element 441 of the trigger to lie on the axis of the bag.

The base 20 may advantageously be constituted by a self-weighting mat.

The bag may take diverse forms, it may be of cylindrical shape or it may assume the shape of a mannequin.

By way of nonlimiting example, the mass of the ballasting means is between 50 kg and 60 kg while the mass of the bag is between 8 kg and 15 kg.

The bag as described could also be fixed to a ceiling, a boom or like structure by a plurality of elastic straps with their lower end fixed to the upper part of the envelope 2.

It goes without saying that the present invention may receive all arrangements and variants from the field of technical equivalents without this departing from the scope of the present patent as defined by the following claims.

The invention claimed is:

1. A training appliance for practicing combat, contact or grappling sports, comprising:

a punching bag formed of a shock absorbing filling material disposed in an internal volume of a substantially cylindrical envelope, the punching bag comprising a lower closing wall constituting a closing bottom wall at a lower end and an upper closing wall at an upper end, the lower part of the punching bag comprises a ballast mounted in a shock absorber and the punching bag has a pivoting movement relative to the shock absorber, wherein the shock absorber is disposed around and in contact with the ballast; and a rigid central tube housed in the shocking absorbing filling material of the punching bag, the rigid central tube extending from the upper closing wall to the bottom closing wall of the envelope, the rigid central tube being fixed to the upper and lower closing walls and forming therewith a framework of the punching bag, upper and lower openings of the rigid central tube respectively communicating with a hole through the upper closing wall and a hole through the bottom closing wall, and a first return member is at least partly housed in the rigid central tube.

2. The training appliance as claimed claim 1, wherein the ballast is formed of a foam peripheral covering comprising substantially a shape of a spherical segment and a ballast weight buried in the foam peripheral covering, the ballast weight is fixed to the lower closing wall, and the ballast weight comprises an axial screw-thread through it into which is screwed a tubular sleeve for a passage of a first return member, the first return member is configured to occupy a stable initial state in which the punching bag is vertical and an unstable final state in which the punching bag is horizontal and laid on the ground.

3. The training appliance as claimed in claim 1, wherein the ballast is formed of a shell defining an internal chamber in which a ballasting material is disposed, the shell comprising a horizontal bottom wall, an envelope wall or lateral wall and a horizontal top wall, that together define the internal chamber of the shell.

4. The appliance as claimed in claim 3, wherein the lower part of the punching bag includes a skirt for protecting the punching bag and fixing it to the ballast.

5. The appliance as claimed in claim 3, wherein the ballast comprises a vertical perforation passing completely through the ballast along a vertical axis of symmetry of the ballast, the vertical perforation constitutes a passage for the first return member, the first return member is configured to occupy a stable initial state in which the punching bag is vertical and an unstable final state in which the punching bag is horizontal and laid on the ground.

6. The appliance as claimed in claim 1, wherein the shock absorber is a low-density foam shock absorber formed by an envelope wall extending in a circle around and in contact with the ballast, the envelope wall defines an open housing configured to receive the ballast, and a shape of the open housing is substantially complementary to that of the ballast.

7. The appliance as claimed in claim 6, wherein the envelope wall has a lower bearing face and an upper border, and a thickness of the envelope wall, measured horizontally, decreases from the bearing face toward the upper border.

8. The appliance as claimed in claim 6, wherein the envelope wall of the shock absorber forms an open ring, two ends of the open ring facing each other and the shock absorber comprises junction elements configured to join the two ends of the open ring to each other.

9. The appliance as claimed in claim 6, wherein the shock absorber is formed by a low-density foam and comprises a skin configure to protect the low-density foam, the skin comprising exhaust holes of calibrated size passing through the skin.

10. The appliance as claimed in claim 1, wherein the shock absorber comprises an upper lip configured to bear on an upper face of the ballast.

11. The appliance as claimed in claim 1, further comprising a second return member mechanically connected to the framework of the punching bag, the second return member is fixed to a first attachment member fastened to the punching bag and the second return member is configured to be mechanically connected to a second attachment member fastened to a ceiling, a boom or any other structure extending above the punching bag.

12. The appliance as claimed in claim 11, wherein the first attachment member is fastened to the framework of the punching bag.

13. The appliance as claimed in claim 11, wherein the second return member is formed of a flexible elongate element in a form of a cable at least partly housed in the rigid central tube, one end of the cable is fixed to an attachment point fastened to the rigid central tube of the punching bag and other end of the cable, external to the punching bag, is mechanically connected to a member configured to be fixed to the second attachment member, and the cable being subjected to forces tending to shorten a distance between the second attachment member and the punching bag, and to urge the punching bag toward the stable initial state.

14. The appliance as claimed in claim 13, further comprising an upper retaining system elastically deformable in a lengthwise direction, mechanically disposed between the second attachment member and a corresponding end of the cable, and the upper retaining system constituting the second return member.

15. The appliance as claimed in claim 14, further comprising a trigger disposed between the upper retaining system and the second return member, the trigger is configured to set a triggering threshold value wherein only the upper retaining system is loaded in an extension when the threshold value is below or equal to the triggering threshold value and the second return member and the upper retaining system are loaded in the extension when the threshold value is above the triggering threshold value, the trigger is formed of at least two trigger elements joined to each other in a separable manner, a first trigger element is mechanically connected to the punching bag and a second trigger element is mechanically connected to the upper retaining system and to the second return member, said at least two triggering elements are configured to be mechanically urged away from each other, and wherein the said at least two trigger elements are configured remain together if an intensity of a mechanical loading that tends to separate the trigger elements is below or equal to the triggering threshold value and said at least two trigger elements are configured to separate from each other if the intensity of the mechanical loading is above the triggering threshold value.

16. The appliance as claimed in claim 14, wherein the trigger is formed of a magnetizable material wall fixed to or forming part of the upper closing wall of the punching bag and a magnet in a magnetic contact with the magnetizable wall, the magnet being fixed by a coupling to the upper retaining system, and the cable of the second return member fixed to the magnet.

* * * * *